US009064458B2

(12) United States Patent
Lee

(10) Patent No.: US 9,064,458 B2
(45) Date of Patent: Jun. 23, 2015

(54) ORGANIC LIGHT EMITTING DISPLAY AND DRIVING METHOD THEREOF

(75) Inventor: Baek-Woon Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 752 days.

(21) Appl. No.: 12/786,254

(22) Filed: May 24, 2010

(65) Prior Publication Data

US 2011/0025671 A1 Feb. 3, 2011

(30) Foreign Application Priority Data

Aug. 3, 2009 (KR) ..... 10-2009-0071280

(51) Int. Cl.

| | |
|---|---|
| ***G09G 3/30*** | (2006.01) |
| ***G09G 3/32*** | (2006.01) |
| ***G09G 3/00*** | (2006.01) |

(52) U.S. Cl.

CPC ..... *G09G 3/3258* (2013.01); *G09G 3/3208* (2013.01); *G09G 3/3233* (2013.01); *G09G 3/003* (2013.01); *G09G 3/3291* (2013.01); *G09G 2300/043* (2013.01); *G09G 2300/0866* (2013.01); *G09G 2310/063* (2013.01); *G09G 2320/043* (2013.01)

(58) Field of Classification Search

CPC ..... G09G 3/3208; G09G 3/3233
USPC ..... 345/76
See application file for complete search history.

(56) References Cited

U.S. PATENT DOCUMENTS

| | | | |
|---|---|---|---|
| 5,990,629 | A | 11/1999 | Yamada et al. |
| 6,229,506 | B1 | 5/2001 | Dawson et al. |
| 6,380,689 | B1 | 4/2002 | Okuda |
| 6,731,276 | B1 | 5/2004 | Ishizuka |
| 7,944,414 | B2 | 5/2011 | Shirasaki et al. |
| 7,960,917 | B2 | 6/2011 | Kimura |
| 8,072,396 | B2 | 12/2011 | Kitazawa et al. |
| 2004/0095298 | A1 | 5/2004 | Miyazawa |
| 2004/0174349 | A1 | 9/2004 | Libsch et al. |
| 2004/0239664 | A1 | 12/2004 | Hu et al. |

(Continued)

FOREIGN PATENT DOCUMENTS

| | | | |
|---|---|---|---|
| CN | 1677470 | A | 10/2005 |
| CN | 1766974 | A | 5/2006 |

(Continued)

OTHER PUBLICATIONS

Taiwan Office action dated May 21, 2013 for corresponding Taiwanese Patent application 099120347, (8 pages).

(Continued)

*Primary Examiner* — Jonathan Boyd
(74) *Attorney, Agent, or Firm* — Christie, Parker & Hale, LLP

(57) ABSTRACT

An organic light emitting display includes a display unit that includes pixels coupled to scan lines, control lines, and data lines; a control line driver for providing control signals to the respective pixels through the control lines; a first power driver for applying a first power to the pixels of the display unit; and a second power driver for applying a second power to the pixels of the display unit, wherein the first power and/or the second power is applied to the pixels of the display unit, having voltage values at different levels, during periods of one frame, and the control signals and the first and second powers are concurrently provided to all of the pixels.

15 Claims, 17 Drawing Sheets

(56) References Cited

U.S. PATENT DOCUMENTS

| | | | | |
|---|---|---|---|---|
| 2005/0083270 | A1* | 4/2005 | Miyazawa | 345/76 |
| 2005/0140600 | A1 | 6/2005 | Kim et al. | |
| 2005/0206591 | A1 | 9/2005 | Wang et al. | |
| 2006/0007072 | A1 | 1/2006 | Choi et al. | |
| 2006/0139255 | A1 | 6/2006 | Kim et al. | |
| 2006/0170625 | A1 | 8/2006 | Kim | |
| 2006/0290614 | A1 | 12/2006 | Nathan et al. | |
| 2007/0035534 | A1 | 2/2007 | Yamazaki | |
| 2007/0115225 | A1 | 5/2007 | Uchino et al. | |
| 2007/0290954 | A1 | 12/2007 | Miyazawa | |
| 2008/0030436 | A1 | 2/2008 | Iida et al. | |
| 2008/0036706 | A1 | 2/2008 | Kitazawa | |
| 2008/0036710 | A1 | 2/2008 | Kim | |
| 2008/0049007 | A1 | 2/2008 | Iida et al. | |
| 2008/0074413 | A1 | 3/2008 | Ogura | |
| 2008/0088548 | A1 | 4/2008 | Lee et al. | |
| 2008/0100544 | A1 | 5/2008 | Wu | |
| 2008/0165095 | A1 | 7/2008 | Jeon et al. | |
| 2008/0252569 | A1 | 10/2008 | Kwon | |
| 2009/0015166 | A1* | 1/2009 | Kwon | 315/156 |
| 2009/0051628 | A1* | 2/2009 | Kwon | 345/77 |
| 2009/0058843 | A1 | 3/2009 | Ishizuka | |
| 2009/0109150 | A1* | 4/2009 | Han et al. | 345/82 |
| 2009/0184896 | A1 | 7/2009 | Kwon | |
| 2009/0284519 | A1 | 11/2009 | Kim et al. | |
| 2009/0315977 | A1* | 12/2009 | Jung et al. | 348/42 |
| 2010/0289883 | A1 | 11/2010 | Goris et al. | |
| 2012/0007842 | A1 | 1/2012 | Nathan et al. | |

FOREIGN PATENT DOCUMENTS

| | | | |
|---|---|---|---|
| CN | 1881397 | A | 12/2006 |
| EP | 1 418 566 | A2 | 5/2004 |
| EP | 1 785 979 | A2 | 5/2007 |
| JP | 61-232494 | | 10/1986 |
| JP | 2000-112428 | | 4/2000 |
| JP | 2001-356738 | | 12/2001 |
| JP | 2004-280059 | | 10/2004 |
| JP | 2004-295131 | | 10/2004 |
| JP | 2007-47342 | A | 2/2007 |
| JP | 2007-148129 | | 6/2007 |
| JP | 2007-206273 | A | 8/2007 |
| JP | 2008-523425 | | 7/2008 |
| JP | 2008-225492 | A | 9/2008 |
| JP | 2008-542845 | A | 11/2008 |
| JP | 2009-152897 | A | 7/2009 |
| KR | 1020060104841 | A | 10/2006 |
| KR | 10-0646989 | B1 | 11/2006 |
| KR | 1020060112991 | A | 11/2006 |
| KR | 10-0658271 | B1 | 12/2006 |
| KR | 10-2007-0029997 | A | 3/2007 |
| KR | 10-2007-0114641 | | 12/2007 |
| KR | 10-0839429 | B1 | 6/2008 |
| KR | 10-2008-0093750 | | 10/2008 |
| TW | 200630932 | A | 9/2006 |
| TW | 200746782 | A | 12/2007 |
| TW | 200816142 | A | 4/2008 |
| TW | 200818099 | A | 4/2008 |
| TW | 200820199 | A | 5/2008 |
| WO | WO 2007/021458 | | 2/2007 |

OTHER PUBLICATIONS

SIPO Office Action dated Jun. 11, 2012 of the corresponding Chinese Patent Application No. 201010214454.0, noting listed references in this IDS.

KIPO Office action dated Oct. 31, 2011 in priority application KR 10-2009-0071280, 2 pps.

Japanese Office action issued on Feb. 14, 2012, in corresponding Japanese Patent Application No. 2009-254936, 5pp.

Korean Office Action dated Mar. 8, 2011, corresponding to Korean priority patent application KR 10-2009-0071280, 4 pgs.

European Patent Office action dated Sep. 7, 2011, for corresponding application 10171396.4, 18 pages.

Partial European Search Report dated Oct. 5, 2010 of the European Patent Application No. 10171396.4.

EPO Search Report dated Nov. 2, 2010 for European Patent application 10171400.4, (6 pages).

KIPO Office action dated Mar. 8, 2011 for Korean Patent application 10-2009-0071279, (5 pages).

KIPO Office action dated Jul. 28, 2011 for Korean Patent application 10-2009-0071279, (1 page).

JPO Office action dated Aug. 7, 2012 for Japanese Patent application 2009-244710, (2 pages).

U.S. Office action dated Mar. 15, 2013, for cross reference U.S. Appl. No. 12/939,111, (12 pages).

U.S. Office action dated Jun. 21, 2013, for cross reference U.S. Appl. No. 12/784,411, (29 pages).

Taiwan Office action dated Aug. 15, 2013, with English translation, for Taiwanese Patent application 099120349, (9 pages).

Taiwanese Patent Gazette dated Apr. 21, 2014, with English abstract, for Taiwanese Patent application 099120349, (2 pages).

SIPO Office action dated Jun. 11, 2012 for Chinese Patent application 201010228279.0, (3 pages).

SIPO Certificate of Invention Patent dated Feb. 5, 2014, for corresponding Chinese Patent Application No. 1343630 (3 pages).

U.S. Office action dated Dec. 18, 2013, for cross reference U.S. Appl. No. 12/784,411, (31 pages).

SIPO Certificate of Invention Patent dated Mar. 12, 2014, for Chinese Patent application 201010228279.0, with English translation of p. 1 only, (3 pages).

U.S. Office action dated Jun. 11, 2014, for cross reference U.S. Appl. No. 12/784,411, (30 pages).

Japanese Office Action dated Aug. 19, 2014 for JP Patent Application No. 2009-254936.

* cited by examiner

ORGANIC LIGHT EMITTING DISPLAY AND DRIVING METHOD THEREOF

CROSS-REFERENCE TO RELATED APPLICATIONS

This application claims priority to and the benefit of Korean Patent Application No. 10-2009-0071280, filed on Aug. 3, 2009, in the Korean Intellectual Property Office, the entire content of which is incorporated herein by reference.

BACKGROUND

1. Field

An aspect of one embodiment of the present invention is directed to an organic light emitting display, and a driving method thereof.

2. Description of Related Art

Various flat panel displays with reduced weight and volume in comparison to a cathode ray tube display have been developed. The various flat panel displays include a liquid crystal display (LCD), a field emission display (FED), a plasma display panel (PDP), an organic light emitting display, etc.

Among the various flat panel displays, the organic light emitting display, which displays an image using organic light emitting diodes (OLEDs) that light-emit light by a re-combination of electrons and holes, has a rapid response speed and low power consumption.

Generally, organic light emitting displays can be classified as a passive matrix type OLED (PMOLED) display and an active matrix type OLED (AMOLED) display according to a method of driving the OLEDs.

The AMOLED display includes a plurality of gate lines, a plurality of data lines, a plurality of power lines, and a plurality of pixels that are coupled to the lines and arranged in a matrix form. Also, each of the pixels generally includes an OLED, two transistors, e.g., a switching transistor that transfers a data signal and a driving transistor that drives the OLED according to the data signal, and a capacitor that maintains the data voltage.

The AMOLED display has low power consumption, but the amount of currents flowing through its OLEDs vary according to deviations in threshold voltage of its transistors to cause display non-uniformity.

In other words, since the characteristics of the transistors provided in each pixel are changed according to variables in their manufacturing processes, it is difficult to manufacture the transistors so that the characteristics of all of the transistors in the AMOLED display are identical, thereby causing deviations in the threshold voltage between the pixels.

A compensation circuit that includes a plurality of transistors and capacitors can be additionally included in the respective pixels. However, the additional compensation circuit causes additional transistors and capacitors to be added in each pixel.

If the compensation circuit is added in the respective pixels as described above, the transistors and capacitors that constitute each pixel and the signal lines that control the transistors are added so that in a bottom emission type AMOLED display, an aperture ratio is reduced, and the probability that defects are generated is increased due to the increased complexity of the circuit.

Moreover, there is a recent demand for a high-speed scan driving of 120 Hz or more in order to reduce or eliminate the screen motion blur phenomenon. However, in this case, a charging time available for each scan line is significantly reduced. In other words, when the compensation circuit is provided in each pixel so that a plurality of transistors are additionally provided in each pixel coupled to one scan line, its capacitive load becomes larger, such that the high-speed scan driving is difficult to be implemented.

SUMMARY OF THE INVENTION

Aspects of an embodiment of the present invention are directed toward an organic light emitting diode (OLED) display that includes OLEDs, where each pixel includes an OLED and a pixel circuit coupled thereto. The pixel circuit includes three transistors and two capacitors, the pixel being driven in a simultaneous (or concurrent) emission scheme, and is able to perform the threshold voltage compensation of the driving transistors provided in the pixels and the high-speed driving thereof, and a driving method thereof.

According to an embodiment of the present invention, an organic light emitting display includes: a display unit including a plurality of pixels coupled to scan lines, control lines, and data lines; a control line driver for providing control signals to the pixels through the control lines; a first power driver for applying a first power to the pixels of the display unit; and a second power driver for applying a second power to the pixels of the display unit. The first power and/or the second power is applied to the pixels of the display unit, having voltage values at different levels, during periods of one frame, and the control signals and the first and second powers are concurrently provided to all of the pixels included in the display unit.

The organic light emitting display may further include: a scan driver for supplying scan signals to the pixels through the scan lines; a data driver for supplying data signals to the pixels through the data lines; and a timing controller for controlling the control line driver, the first power driver, the second power driver, the scan driver, and the data driver.

The first power driver may be adapted to apply the first power having voltage values at three different levels for each period during the periods of one frame, and the second power driver may be adapted to apply the second power having a voltage value at a fixed level during the all of the periods of one frame.

The first power driver and the second power driver may be adapted to respectively apply the first and second powers each having voltage values at two different levels for each period during the periods of one frame.

The first power driver may be adapted to apply the first power having a voltage value at a fixed level for all of the periods of one frame, and the second power driver may be adapted to apply the second power having voltage values at three different levels for each period during the periods of one frame.

The scan signals may be applied sequentially by each of the scan lines for a partial period of the periods of one frame and may be applied concurrently to the scan lines during the periods other than the partial period.

Widths of the sequentially applied scan signals may be applied at two horizontal time, and adjacently applied ones of the scan signals may be applied to be overlapped with each other by one horizontal time.

The data signals may be applied sequentially to the pixels by each of the scan lines corresponding to the sequentially applied scan signals, and the data signals may be concurrently applied to all of the pixels through the data lines during the periods other than the partial period.

Each of the pixels may include: a first transistor having a gate electrode coupled to a scan line of the scan lines, a first electrode coupled to a data line of the data lines, and a second electrode coupled to a first node; a second transistor having a gate electrode coupled to a second node, a first electrode coupled to the first power, and a second electrode; a first capacitor coupled between the first node and the first electrode of the second transistor; a second capacitor coupled between the first node and the second node; a third transistor having a gate electrode coupled to a control line of the control lines, a first electrode coupled to the gate electrode of the second transistor, and a second electrode coupled to the second electrode of the second transistor; and an organic light emitting diode having an anode electrode coupled to the second electrode of the second transistor and a cathode electrode coupled to the second power.

The first to third transistors may be PMOS transistors.

When the first power and the control signals may be applied at a high level to the pixels included in the display unit, the pixels may be concurrently light-emitted at brightness corresponding to the data signals pre-stored for each of the pixels.

Each of the pixels may includes a first transistor having a gate electrode coupled to a scan line of the scan lines, a first electrode coupled to a data line of the data lines, and a second electrode coupled to a first node; a second transistor have a gate electrode coupled to a second node, a first electrode coupled to a second power, and a second electrode; a first capacitor coupled between the first node and the first electrode of the second transistor; a second capacitor coupled between the first node and the second node; a third transistor having a gate electrode coupled to a control line of the control lines, a first electrode coupled to the gate electrode of the second transistor, and a second electrode coupled to the second electrode of the second transistor; and an OLED having a cathode electrode coupled to the second electrode of the second transistor and an anode electrode coupled to the first power.

The first to third transistors may be NMOS transistors.

Another embodiment of the present invention is directed to a driving method of an organic light emitting display. The method includes: (a) initializing voltages of respective nodes of a plurality of pixel circuits included in respective pixels by concurrently applying a first power, a second power, scan signals, control signals, and data signals, having voltage values at respective levels, to all of the pixels that constitute a display unit; (b) dropping a voltage of an anode electrode of an OLED included in the respective pixels below a voltage of a cathode electrode of the OLED by concurrently applying the first power, the second power, the scan signals, the control signals, and the data signals, having the voltage values at respective levels, to all of the pixels; (c) storing a threshold voltage of a driving transistor included in the respective pixels by concurrently applying the first power, the second power, the scan signals, the control signals, and the data signals, having the voltage values at respective levels, to all of the pixels; (d) applying the scan signals sequentially to the pixels coupled to scan lines of the display unit and applying the data signals to the pixels by each of the scan lines corresponding to the sequentially applied scan signals; (e) light-emitting concurrently al of the pixels at brightness corresponding to the data signals stored in the respective pixels by concurrently applying the first power, the second power, the scan signals, the control signals, and the data signals, having the voltage values at respective levels, to all of the pixels; and (f) turning off emission of the pixels by concurrently applying the first power, the second power, the scan signals, the control signals, and the data signals, having the voltage values at respective levels, to all of the pixels and thus lowering the voltage of the anode electrode of the OLED included in the respective pixels.

One frame may be implemented through (a) to (f).

For a progressively displayed frame, an nth frame may display a left-eye image and an $(n+1)^{th}$ frame may display a right-eye image.

An entire time between an emission period of the nth frame and an emission frame of the $(n+1)^{th}$ frame may be synchronized with a response time of a shutter glasses.

Each of the pixels may includes a first PMOS transistor having a gate electrode coupled to a scan line of the scan lines, a first electrode coupled to a data line, and a second electrode coupled to a first node; a second PMOS transistor having a gate electrode coupled to a second node, a first electrode coupled to the first power, and a second electrode; a first capacitor coupled between the first node and the first electrode of the second transistor; a second capacitor coupled between the first node and the second node; a third PMOS transistor having a gate electrode coupled to a control line, a first electrode coupled to the gate electrode of the second transistor, and a second electrode coupled to the second electrode of the second transistor; and an organic light emitting diode (OLED) having an anode electrode coupled to the second electrode of the second transistor and a cathode electrode coupled to the second power.

In (a), the first power may be applied at a middle level, the scan signals may be applied at a low level, and the control signals may be applied at a high level.

Here, (b) may includes: (b1) wherein the first power is applied at a low level, the scan signal may be applied at a high level or a low level, and the control signals may be applied at a high level; (b2) wherein the first power may be applied at a low level, the scan signals may be applied at a high level or a low level, and the control signals may be applied at a high level; (b3) wherein the first power may be applied at a middle level, the scan signals may be applied at a high level or a low level, and the control signals may be applied at a high level.

In (b1) and (b2), if the scan signals are applied at a low level, the data signals corresponding thereto may be applied at a low level.

In (b3), if the scan signals are applied at a low level, the data signals corresponding thereto may be applied at a high level.

Here (c) may include: (c1) wherein the first power may be applied at a middle level, the scan signals may be applied at a high level or a low level, and the control signals may be applied at a high level; and (c2) and (c3), wherein the first power may be applied at a middle level, the scan signals may be applied at a low level, and the control signals may be applied at a low level.

In (c1), if the scan signals are applied at a low level, the data signals corresponding thereto may be applied at a high level.

In (d), the control signals may be applied at a low level.

In (d), widths of the sequentially applied scan signals may be applied at two horizontal time, adjacently applied ones of the scan signals being applied to be overlapped with each other by one horizontal time.

In (e), the first power may be applied at a high level, and the scan signals and the control signals may be applied at a high level.

In (f), the first power may be applied at a middle level, and the scan signal and the control signal may be applied at a high level.

Moreover, other embodiments with more improved performance can be implemented through the simultaneous (or concurrent) emission scheme as described for three dimensional (3D) display.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
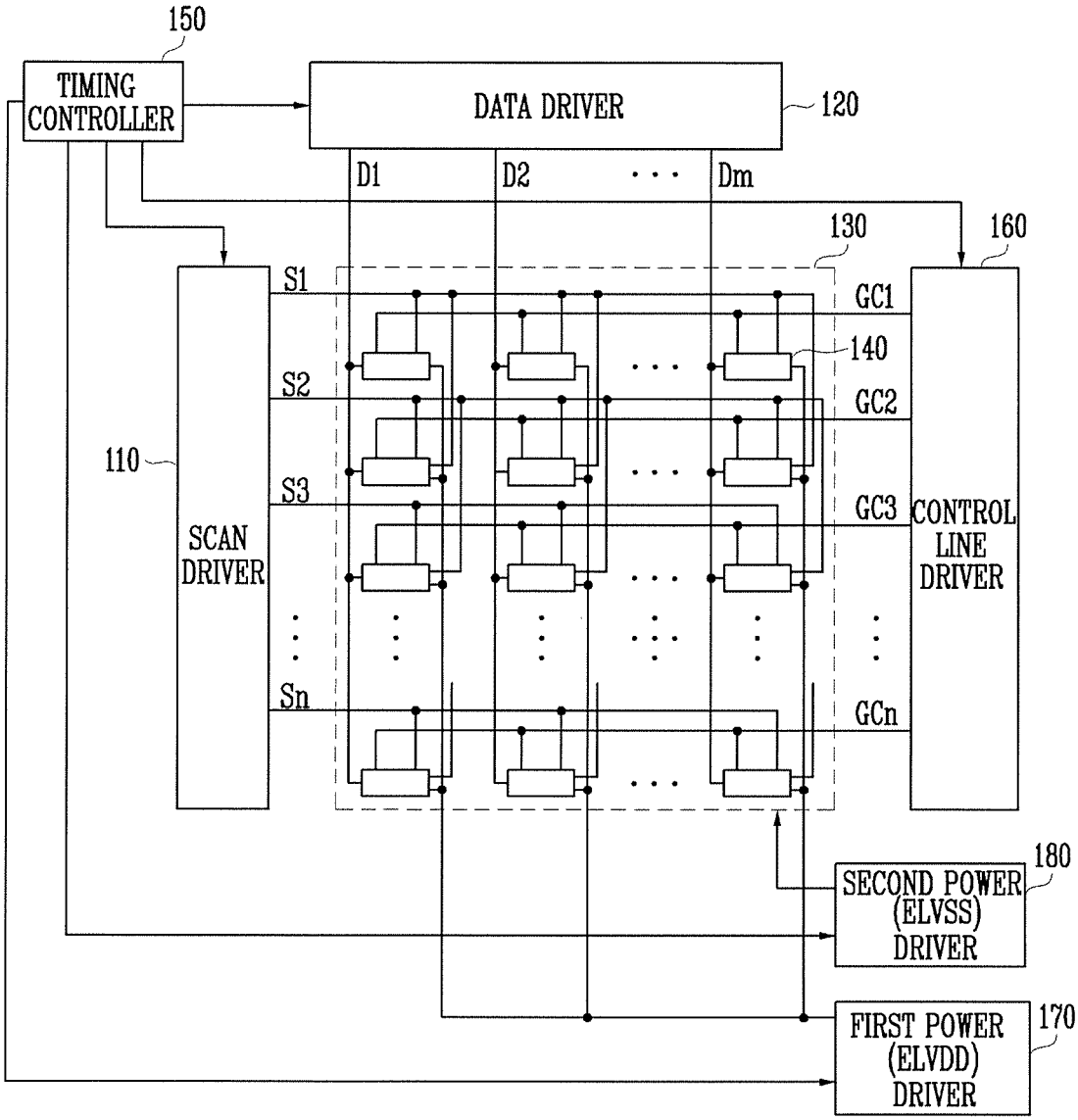
FIG. 1 is a block diagram of an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled to the second element or indirectly coupled to the second element via a third element. Further, some of the elements that are not essential to a complete understanding of the invention are omitted for clarity. Also, like reference numerals refer to like elements throughout.

Figure 2:
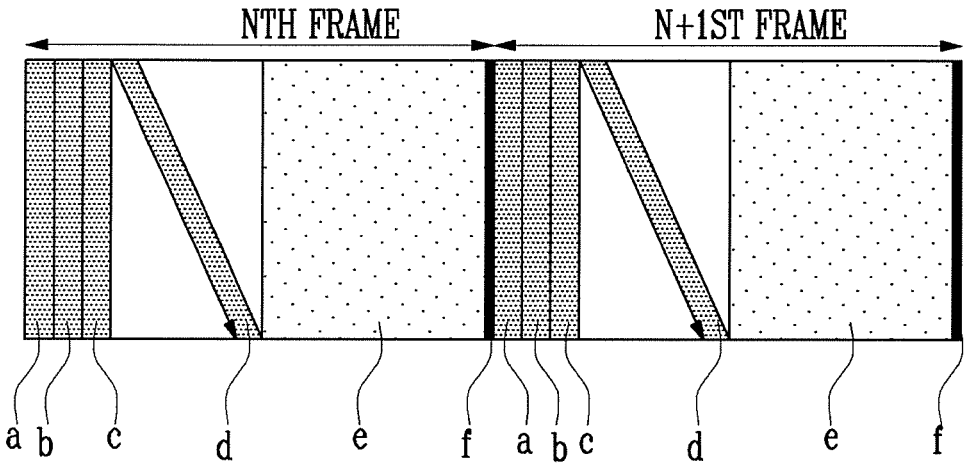
FIG. 2 is a diagram showing a driving operation in a simultaneous emission scheme according to an embodiment of the present invention.

FIG. 1 is a block diagram of an organic light emitting display according to an embodiment of the present invention, and FIG. 2 is a diagram showing a driving operation in a simultaneous emission scheme according to an embodiment of the present invention.

Referring to FIG. 1, the organic light emitting display according to one embodiment of the present invention includes a display unit 130 that includes pixels 140 that are coupled to scan lines S1 to Sn, control lines GC1 to GCn and data lines D1 to Dm, a scan driver 110 that provides scan signals to the respective pixels through the scan lines S1 to Sn, a control line driver 160 that provides control signals to the respective pixels through the control lines GC1 to GCn, a data driver 120 that provides data signals to the respective pixels through the data lines D1 to Dm, and a timing controller 150 that controls the scan driver 110, the data driver 120, and the control line driver 160.

The pixels 140 are positioned in regions defined by the crossings of the scan lines S1 to Sn and the data lines D1 to Dm. The pixels 140 receive first power ELVDD and second power ELVSS from the outside. Each of the pixels 140 controls the amount of current supplied to the second power ELVSS from the first power ELVDD through an organic light emitting diode (OLED) corresponding to the data signal. Then, light having a brightness (e.g., a predetermined brightness) is generated from the OLED.

However, in the embodiment of FIG. 1, the first power ELVDD and/or the second power ELVSS is applied to the respective pixels 140 of the display unit at voltage values at different levels during one frame.

To this end, a first power ELVDD driver 170 that controls the supply of the first power ELVDD and/or a second power ELVSS driver 180 that controls the supply of the second power ELVDD are further provided, and the first power ELVDD driver 170 and the second power ELVSS driver 180 are controlled by the timing controller 150.

In a related art, the first power ELVDD is supplied having a voltage at a fixed high level, and the second power ELVSS is supplied having a voltage at a fixed low level to pixels of a display unit.

However, in the embodiment of FIG. 1, the first power ELVDD and the second power ELVSS are applied in accordance with the following three schemes.

In a first scheme, the first power ELVDD is applied having voltage values at three different levels, and the second power ELVSS is applied having a voltage at a fixed low level (for example, ground).

In the first scheme, the second power ELVSS driver 180 outputs the second power ELVSS with a voltage value at an always constant level (e.g., GND) so that there is no need to implement the second power ELVSS driver 180 as a separate driving circuit, thereby making it possible to reduce circuit costs. The first power ELVDD has a negative voltage value (for example, −3V) as one of the three levels so that the circuit constitution of the first power ELVDD driver 170 may be complicated in the first scheme, however.

In a second scheme, the first power ELVDD and the second power ELVSS are applied each having voltage values at two levels. In this case, both the first power driver 170 and the second power driver 180 are provided.

In a third scheme, the first power ELVDD is applied having a voltage value at a fixed high level, and the second power ELVSS is applied having voltage values at three different levels, being opposite to the first scheme.

In other words, in the third scheme, the first power driver 170 outputs the voltage value at an always constant level so that there is no need to implement the first power driver 170 as a separate driving circuit, thereby making it possible to reduce circuit costs. The second power ELVSS has a positive voltage value as one of its three levels so that the circuit constitution of the second power ELVSS driver 180 may be complicated, in the third scheme, however.

Figure 4:
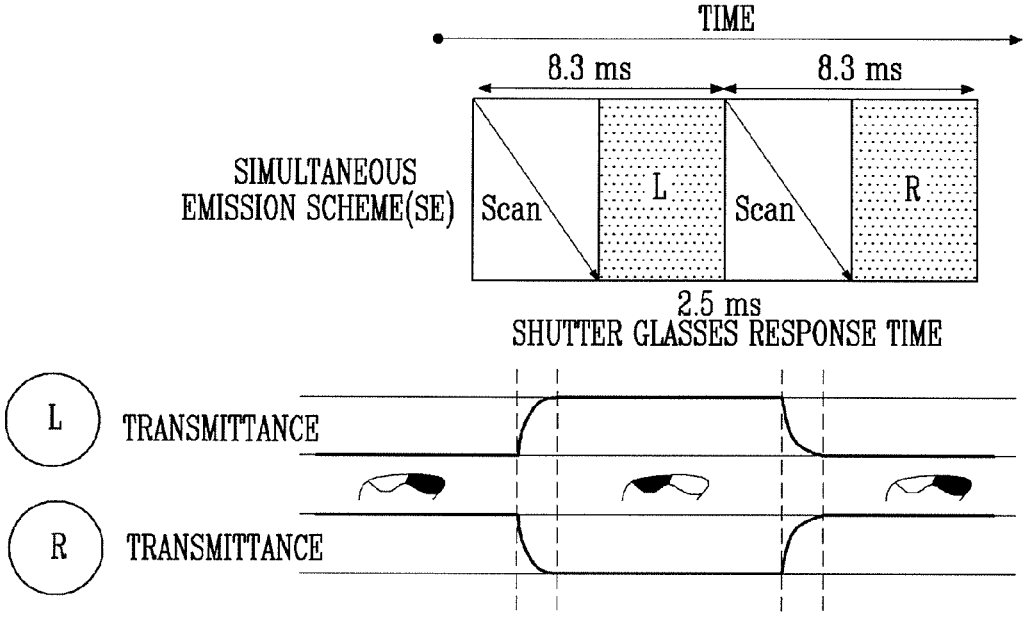
FIG. 4 is a diagram showing an example where a pair of shutter glasses for 3D display is implemented in a simultaneous emission scheme according to an embodiment of the present invention.

The timing control diagram for the above described three schemes to apply the first power ELVDD and the second power ELVSS will be shown in more detail in FIG. 4.

Moreover, in the embodiment of FIG. 1, the organic light emitting display is driven in a simultaneous emission scheme rather than in a progressive emission scheme. As shown in FIG. 2, this means that data is input in sequence during the period of one frame, and after the input of the data is completed, the lighting of the pixels in accordance with the data of one frame is implemented through the entire display unit 130, that is, all of the pixels 140 of the display unit.

In other words, in the progressive emission scheme according to the related art, the emission is performed in sequence right after data is input in sequence per scan line. However, in the embodiment of FIG. 1, the input of the data is performed in sequence, but the emission is concurrently performed with all of the pixels 140 after the input of the data is completed.

Referring to FIG. 2, the driving step according to an embodiment of the present invention is divided into (a) an initialization step, (b) a reset step, (c) a threshold voltage compensation step, (d) a scanning step (a data input step), (e) an emission step, and (f) an emission turn-off step. Herein, (d) the scanning step (the data input step) is performed in sequence per the respective scan lines, but (a) the initialization step, (b) the reset step, (c) the threshold voltage compensation step, (e) the emission step, and (f) the emission turn-off step are performed simultaneously (or concurrently) on the entire display unit 130.

Here, (a) the initialization step is a period where voltages at nodes of the pixel circuits respectively provided in the pixels are initialized to be identical with that in inputting the threshold voltage of the driving transistor, and (b) the reset step, which is a step where the data voltage applied to each pixel 140 of the display unit 130 is reset, is a period where the voltage of the anode electrode of the OLED of each pixel 140 is dropped below the voltage of the cathode electrode so that the organic light emitting diode is not light-emitted.

Further, (c) the threshold voltage compensation step is a period where the threshold voltage of the driving transistor provided in each pixel 140 is compensated for, and (f) the emission turn-off step is a period where the emission of each pixel 140 is turned off for a black insertion or a dimming after the emission is performed in each pixel.

Therefore, the signals applied during (a) the initialization step, (b) the reset step, (c) the threshold voltage compensation step, (e) the emission step, and (f) the emission turn-off step, that is, the scan signals applied to the respective scan lines S1 to Sn, the first power ELVDD and/or the second power ELVSS applied to the respective pixels 140, and the control signals applied to the respective control lines GC1 to GCn are simultaneously (or concurrently) applied to the pixels 140 provided in the display unit 130 at respective voltage levels (e.g., predetermined voltage levels).

In the case of the "simultaneous emission scheme" according to one embodiment of FIG. 2, the respective operation periods ((a) to (f) steps) are clearly divided in time. Therefore, the number of the transistors of the compensation circuit provided in the respective pixels 140 and the number of the signal lines that control thereof can be reduced such that the pair of shutter glasses for 3D display can be easily implemented.

When a user wears the pair of shutter glasses for 3D display that switches transmittance of left eye and right eye between 0% and 100% to see a screen, which is displayed on the display unit of the organic light emitting display, the screen is output as a left-eye image and a right-eye image for each frame so that the user sees the left-eye image with only his or her left-eye and the right-eye image with only his or her right-eye, thereby implementing three-dimensional effects.

Figure 3:
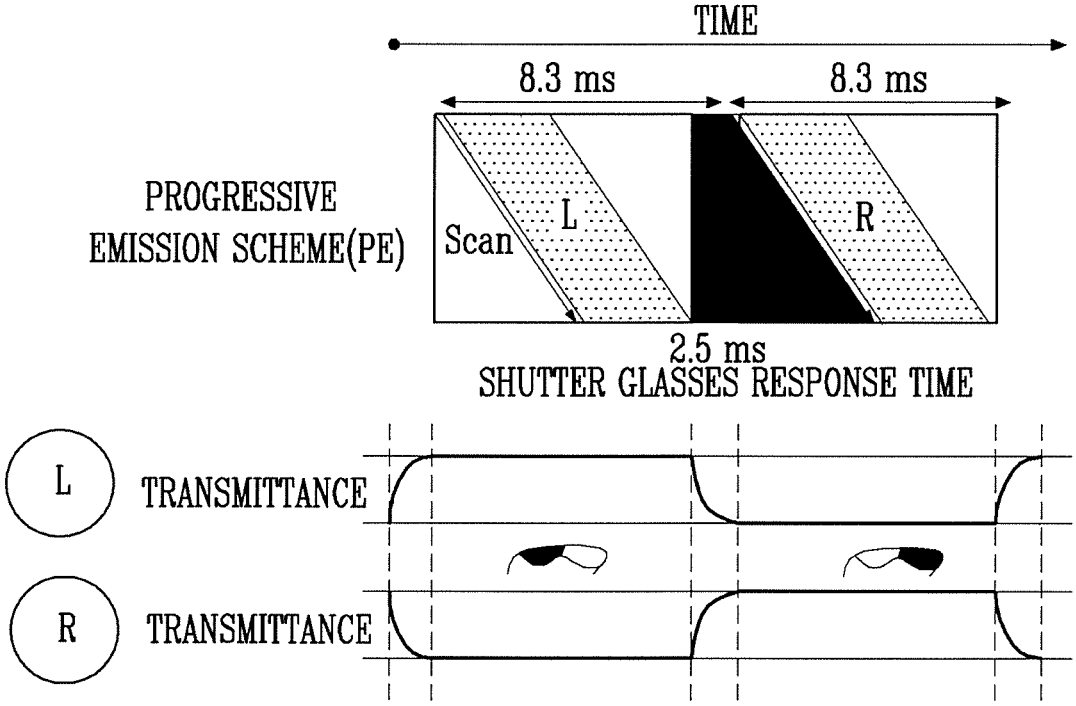
FIG. 3 (Related Art)
FIG. 3 is a diagram showing an example where a pair of shutter glasses for 3D display is implemented in a progressive emission scheme according to a related art.

FIG. 3 is a diagram showing an example where a pair of shutter glasses for 3D display is implemented in a progressive emission scheme according to a related art, and FIG. 4 is a diagram showing an example where a pair of shutter glasses for 3D display is implemented in a simultaneous emission scheme according to an embodiment of the present invention.

Figure 5:
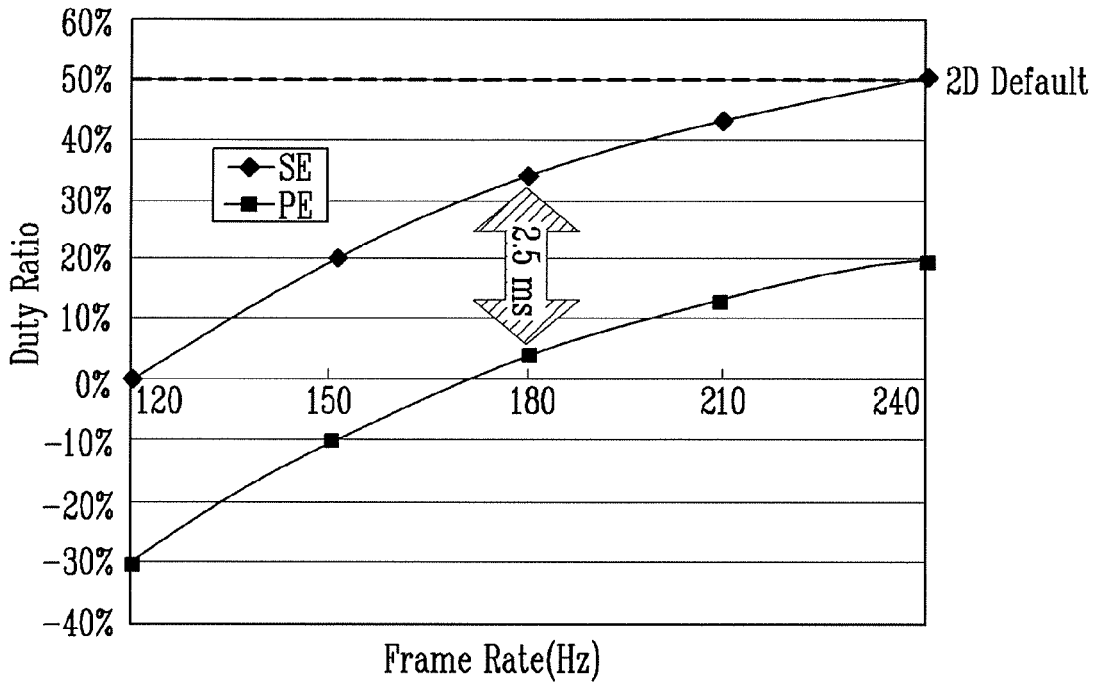
FIG. 5 is a graph comparing the duty ratios obtained in the simultaneous emission scheme and the progressive emission scheme.

FIG. 5 is a graph comparing the duty ratio that can be obtained in the cases of the simultaneous emission scheme and the progressive emission scheme.

When the screen is output in the progressive emission scheme according to the related art as aforementioned in the case of implementing such a pair of shutter glasses for 3D display, as shown in FIG. 3, the response time (for example, 2.5 ms) of the pair of shutter glasses is finite (e.g., non-zero) so that the emission of pixels should be turned off during the response time in order to prevent a cross talk phenomenon between the left eye/right eye images.

In other words, a non-light emitting period should be additionally generated between a frame ($n^{th}$ frame) where the left-eye image is output and a frame ($(n+1)^{th}$ frame) where the right-eye image is output during the response time. As such, the duty ratio of the emission time becomes lower.

In the case of the "simultaneous emission scheme" according to an embodiment of the present invention, referring to FIG. 4, the light-emitting step is simultaneously (or concurrently) performed on all the pixels as aforementioned, and the non-emission period is performed during the periods other than the light-emitting step so that the non-emission period between the period where the left-eye image is output and the period where the right-eye image is output is naturally provided.

In other words, the emission turn-off period, the reset period, and the threshold voltage compensation period, which are the periods between the emission period of the $n^{th}$ frame and the emission period of the $(n+1)^{th}$ frame, are non-light emitted so that if the entire time of these periods are synchronized with the response time (for example, 2.5 ms) of the pair of shutter glasses, there is no need to separately reduce the duty ratio, which is different from the progressive emission scheme according to the related art.

Therefore, when implementing the pair of shutter glasses for 3D display, the "simultaneous emission scheme" can secure the duty ratio by the response time of the pair of shutter glasses as compared to the "progressive emission scheme" according to the related art, making it possible to improve performance as shown in the graph of FIG. 5.

Figure 6:
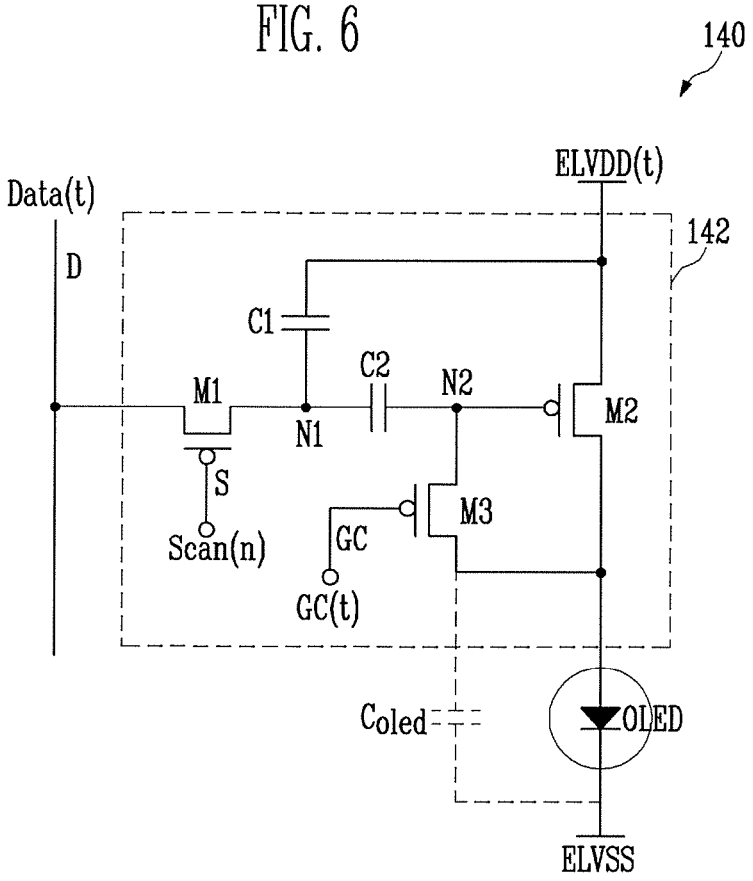
FIG. 6 is a circuit diagram of a pixel in FIG. 1 according to one embodiment of the present invention.
Figure 7A:
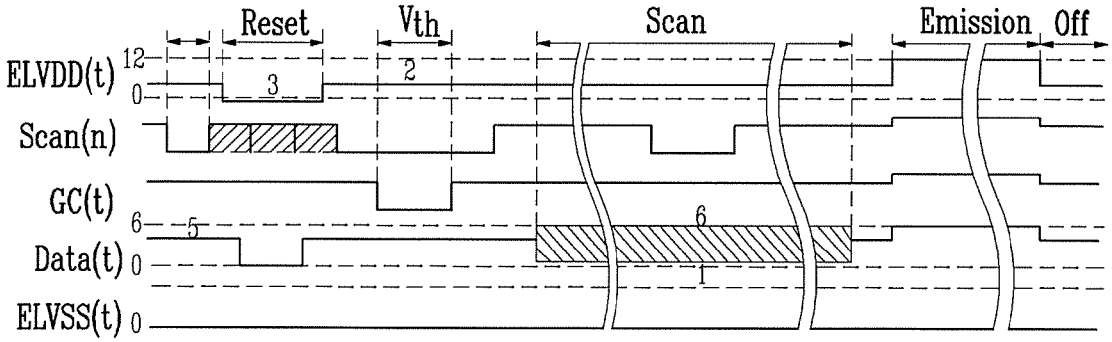
FIGS. 7A, 7B, and 7C are driving timing diagrams of the pixel in FIG. 6.
Figure 7B:
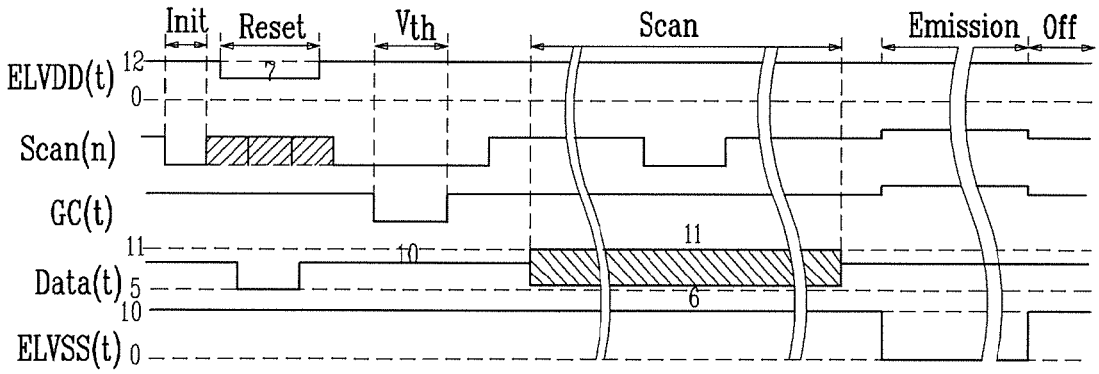
Figure 7C:
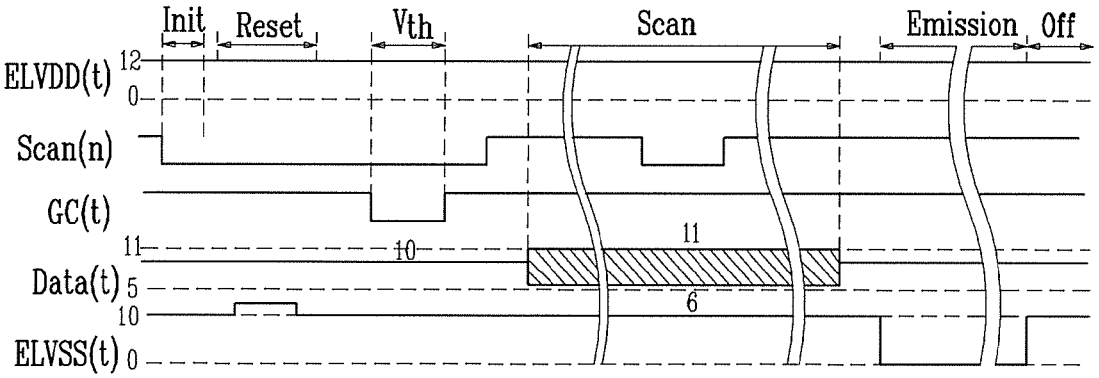

FIG. 6 is a circuit diagram of the pixel 140 of FIG. 1 according to one embodiment of the present invention, and FIGS. 7A to 7C are driving timing diagrams of the pixel in FIG. 6.

Referring to FIG. 6, the pixel 140 according to one embodiment of the present invention includes an OLED and a pixel circuit 142 that supplies current to the OLED.

The anode electrode of the OLED is coupled to the pixel circuit 142, and the cathode electrode of the OLED is coupled to a second power ELVSS. The OLED generates light having a brightness (e.g., a predetermined brightness) corresponding to the current supplied from the pixel circuit 142.

However, in the embodiment of FIG. 1, the respective pixels 140 that constitute the display unit 130 receive data signals supplied to the data lines D1 to Dm when scan signals are supplied sequentially to the scan lines S1 to Sn for a partial period (the aforementioned (d) step) of one frame, but the scan signals applied to the respective scan lines S1 to Sn, the first power ELVDD and/or second power ELVSS applied to the respective pixels 140, control signals applied to the respective control lines GC1 to GCn are simultaneously (or concurrently) applied to the respective pixels 140, having respective voltage levels (e.g., predetermined voltages), for other periods ((a), (b), (c), (e), and (f) steps) of one frame.

Therefore, the pixel circuit 142 provided in each of the pixels 140 includes three transistors M1 to M3 and two capacitors C1 and C2 according to one embodiment of the present invention.

Moreover, in the embodiment of FIG. 6, a parasitic capacitor Coled is generated by the anode electrode and the cathode electrode of the organic light emitting diode OLED, the coupling effects by the second capacitor C2 and the parasitic capacitor Coled are utilized. This will be described in more detail with reference to FIG. 8.

Here, the gate electrode of the first transistor M1 is coupled to a scan line S and the first electrode of the first transistor M1 is coupled to a data line D. And, the second electrode of the first transistor M1 is coupled to a first node N1.

In other words, a scan signal Scan(n) is input into the gate electrode of the first transistor M1, and a data signal Data(t) is input into the first electrode.

In addition, the gate electrode of the second transistor M2 is coupled to a second node N2, the first electrode of the second transistor M2 is coupled to a first power ELVDD(t), and the second electrode of the second transistor M2 is coupled to the anode electrode of the OLED. Here, the second transistor M2 serves as a driving transistor.

The first capacitor C1 is coupled between the first node N1 and the first electrode of the second transistor M2, that is, the first power ELVDD(t), and the second capacitor C2 is coupled between the first node N1 and the second node N2.

Further, the gate electrode of the third transistor M3 is coupled to a control line GC, the first electrode of the third transistor M3 is coupled to the gate electrode of the second transistor M2, and the second electrode of the third transistor M3 is coupled to the anode electrode of the OLED, which is coupled to the second electrode of the second transistor M2.

Here, a control signal GC(t) is applied to the gate electrode of the third transistor M3, wherein when the third transistor M3 is turned on, the second transistor M2 is diode-connected.

In addition, the cathode electrode of the organic light emitting diode OLED is coupled to the second power ELVSS(t).

In the embodiment shown in FIG. 6, all of the first to third transistors M1 to M3 are implemented as PMOS transistors.

As described above, the respective pixels 140 according to an embodiment of the present invention are driven in the "simultaneous emission scheme," which includes an initialization period Init, a reset period Reset, a threshold voltage compensation period Vth, a scan/data input period Scan, an emission period Emission, and an emission turn-off period Off for each frame, as shown in FIGS. 7A to 7C.

Here, the scan signals are input sequentially to the scan lines and the data signals are input sequentially into the pixels corresponding thereto for the scan/data input period Scan, but the signals having voltage values at respective levels (e.g., predetermined levels), that is, the first power ELVDD(t) and/or the second power ELVSS(t), the scan signal Scan(n), the control signal GC(t), and the data signal Data(t), are concurrently applied to all of the pixels 140 that constitute the display unit for periods other than the scan/data input period Scan.

In other words, the threshold voltage compensation of the driving transistor provided in the respective pixels 140 and the emission operations of the respective pixels are simultaneously (or concurrently) performed in all of the pixels 140 of the display unit for each frame.

However, in one embodiment of the present invention, the first power ELVDD(t) and/or the second power ELVSS(t) may be provided in the following three schemes as shown in FIGS. 7A to 7C, respectively.

In the first scheme, referring to FIG. 7A, the first power ELVDD(t) is applied having voltage values at three different levels (for example, 12V, 2V, and −3V), and the second power ELVSS(t) is applied at a fixed low level (for example, 0V), wherein the voltage range of the data signal is between 0V and 6V.

In other words, in this case, the second power ELVSS driver 180 outputs a voltage value at a constant level GND so that there is no need to be implemented as a separate driving circuit, making it possible to reduce the circuit costs. Here, the first power ELVDD(t) has a negative voltage value (for example, −3V) as one of the three levels so that the circuit constitution of the first power ELVDD driver 170 may be complicated.

Moreover, when driven in signal waveforms shown in FIG. 7A, the scan signal Scan(n) may be applied at "high level (H), high level (H), high level (H)," "high level (H), low level (L), high level (H)," and "low level (L), low level (L), low level (L)" during the reset period. This will be described in more detail with reference to FIGS. 8B to 8D.

In the second scheme, referring to FIG. 7B, the first power ELVDD(t) is applied having voltage values at two levels (for example, 12V and 7V), and the second power ELVSS(t) is also applied having voltage values at two levels (for example, 0V and 10V), wherein the voltage range of the data signal is between 0V and 12V.

In other words, in this case, the driving waveforms may be simplified but both the first power ELVDD driver 170 and the second power driver ELVSS 180 should be provided in order to output the voltage values at different levels.

In the third scheme, referring to FIG. 7C, the first power ELVDD(t) is applied having a voltage value at a fixed high level (for example, 12V), and the second power ELVSS(t) is applied having voltage values at three different levels (for example, 0V, 10V, and 15V), being opposite to the embodiment of FIG. 7A.

In other words, in this case, the first power ELVDD driver 170 outputs the voltage value at the always constant level so that there is no need to be implemented as a separate driving circuit, making it possible to reduce the circuit costs. Here, the second power ELVSS(t) has a positive voltage value among the three levels so that the circuit constitution of the second power ELVSS driver 180 may be complicated.

Hereinafter, the driving in the simultaneous emission scheme according to an embodiment of the present invention will be described in more detail with reference to FIGS. 8A to 8J.

In FIGS. 8A to 8J, a case where the scan signal Scan(n) is applied at "high level (H), low level (L), high level (H)" during the reset period among the driving schemes of FIG. 7A will be described by way of example.

FIGS. 8A to 8J are diagrams for explaining the driving of an organic light emitting display according to an embodiment of the present invention.

For convenience of explanation, although the voltage levels of the input signals are described using concrete numerical values, these are exemplary values for facilitating understanding but are not actual design values.

Moreover, the embodiment of FIGS. 8A to 8J will be described assuming that the capacitance ratio of the first capacitor C1, the second capacitor C2, and the parasitic capacitor Coled of the organic light emitting diode OLED is 1:1:4.

First, referring to FIG. 8A, the voltages of the respective nodes N1 and N2 for the respective pixels 140 of the display unit 130, that is, the pixels in FIG. 6, are initialized to be identical with those during the threshold voltage compensation period to be processed later.

Here, during the initialization period, the first power ELVDD(t) is applied at a middle level (for example, 2V), the scan signal Scan(n) is applied at a low level (for example, −5V), and the control signal GC(t) is applied at a high level (for example, 6V).

Moreover, the data signal Data(t) applied during the initialization period is an initialization voltage Vsus. In the embodiment of FIGS. 8A to 8J, the data signal Data(t) of 5V is applied by way of example, and it is assumed that the voltage difference across the second capacitor C2 is 5V.

Figure 8A:
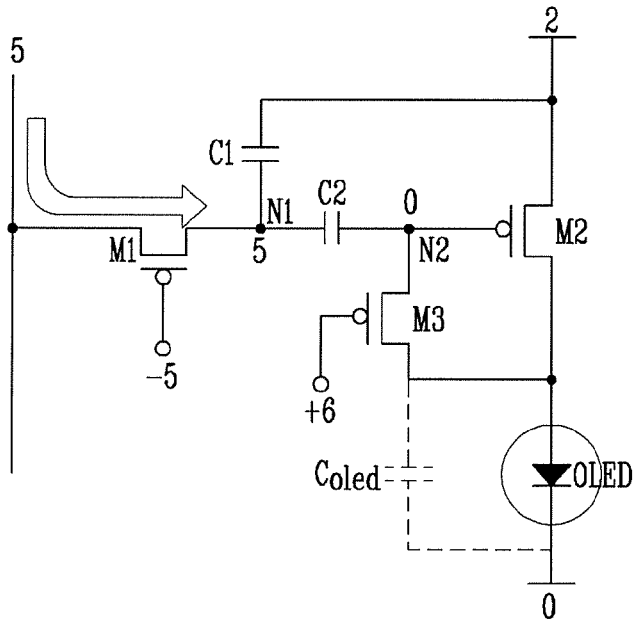
FIGS. 8A, 8B, 8C, 8D, 8E, 8F, 8G, 8H, 8I, and 8J are diagrams for explaining the driving of an organic light emitting display according to an embodiment of the present invention.
Figure 8A:
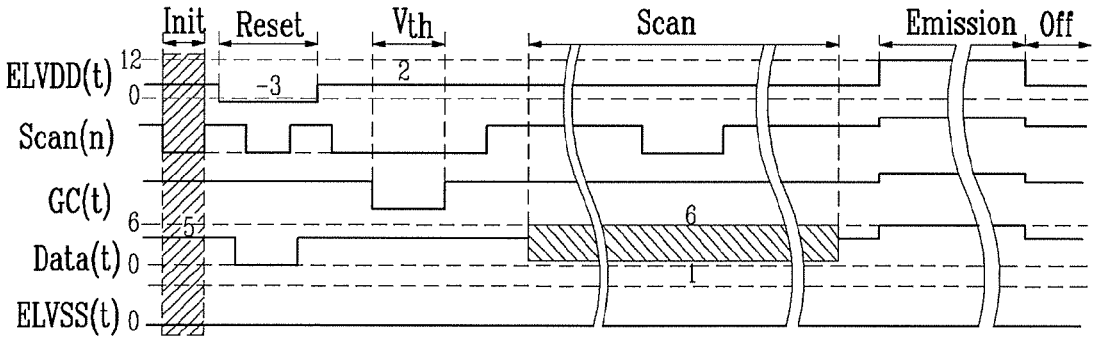
Figure 8B:
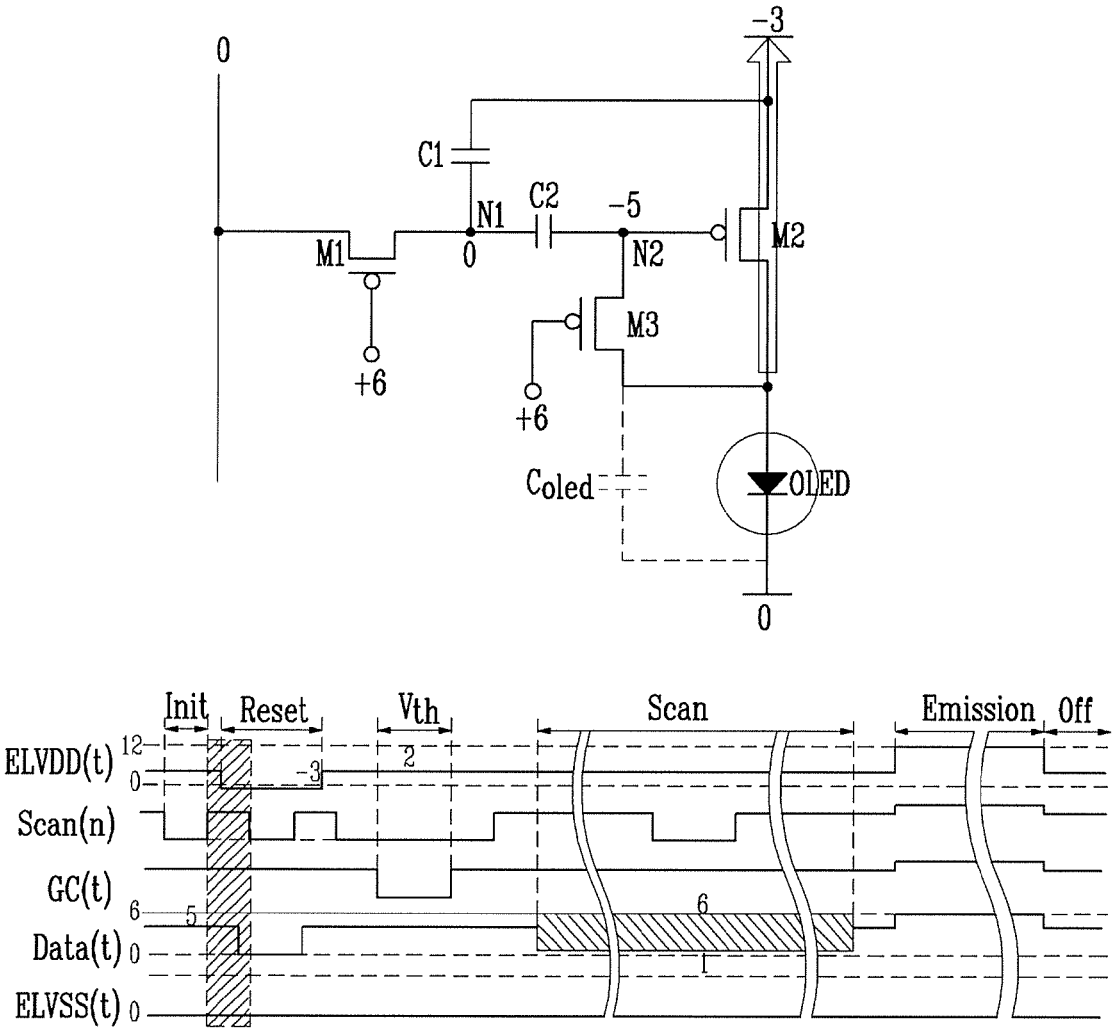
Figure 8C:
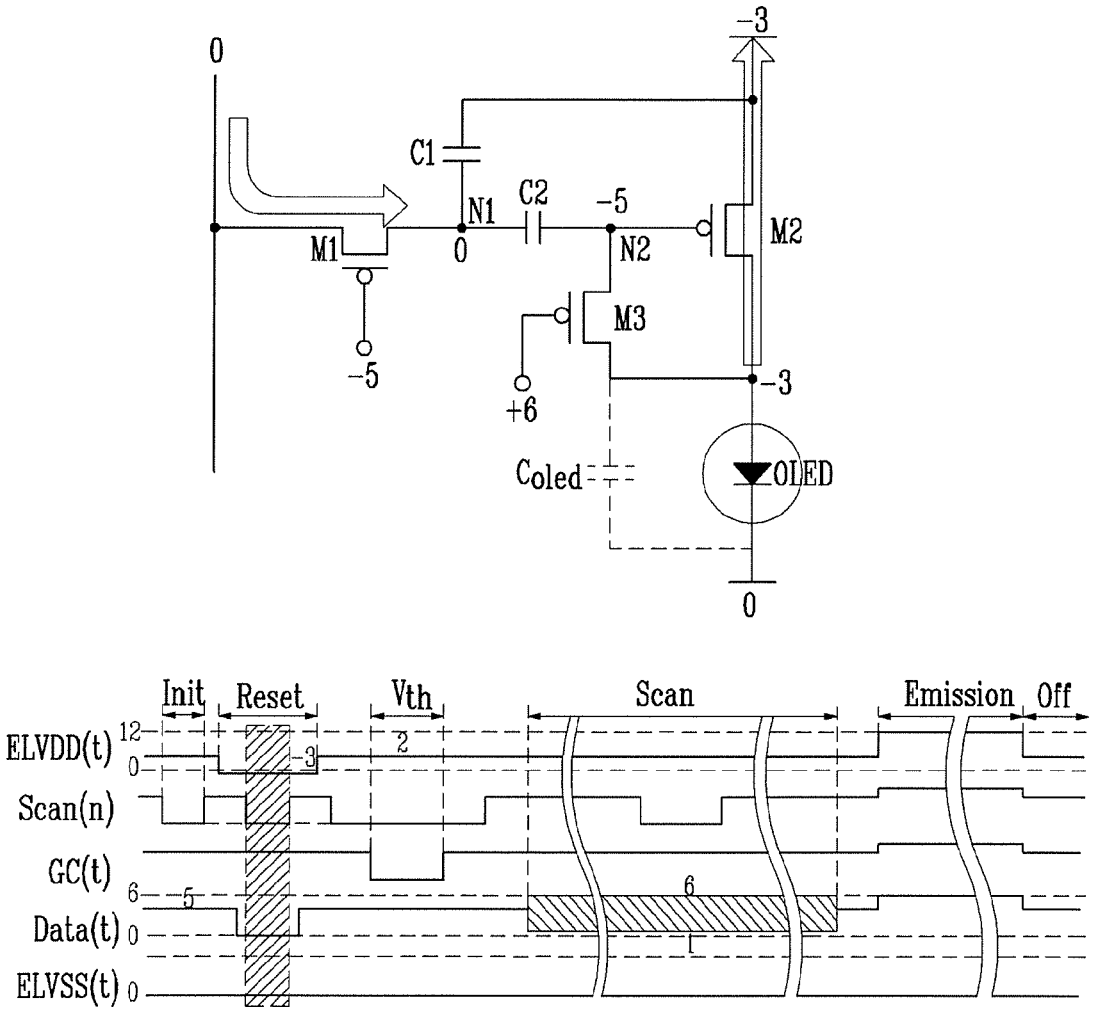
Figure 8D:
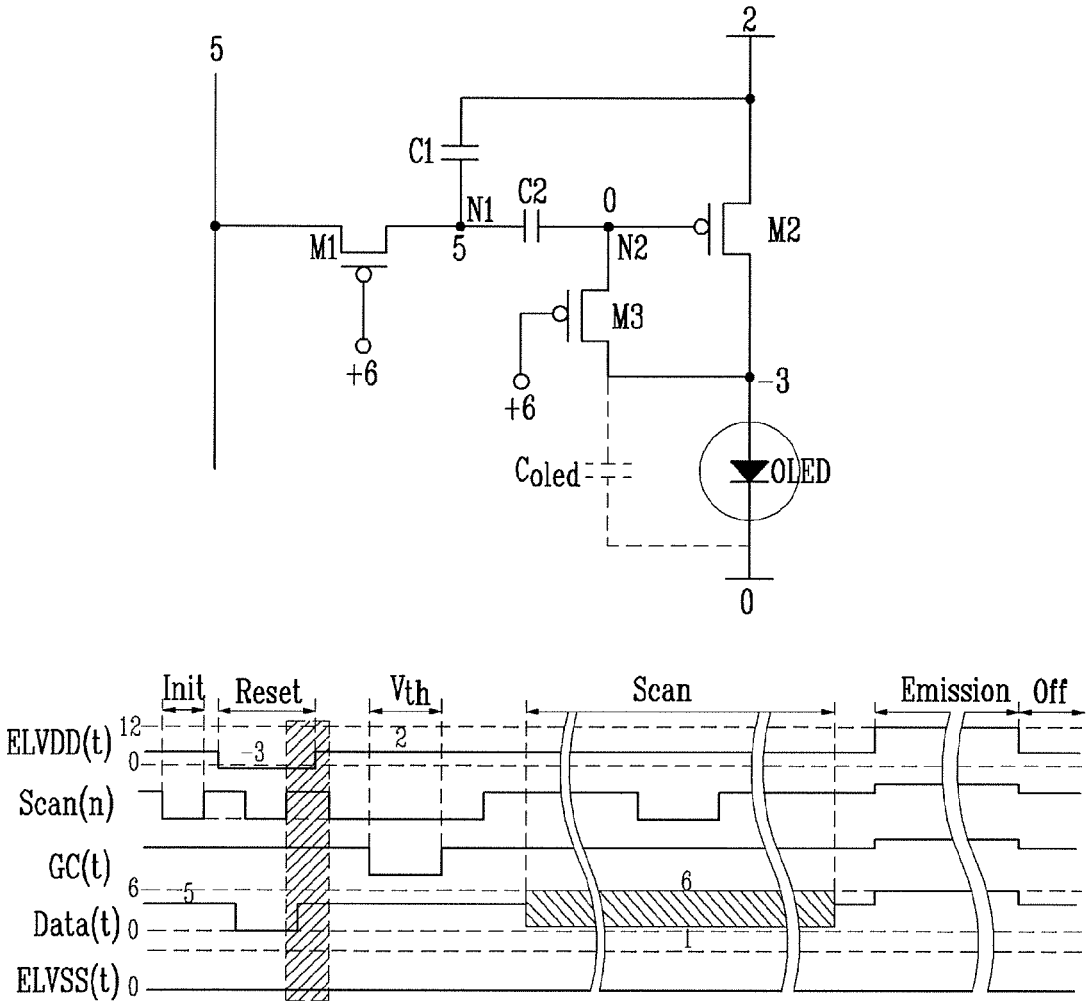
Figure 8E:
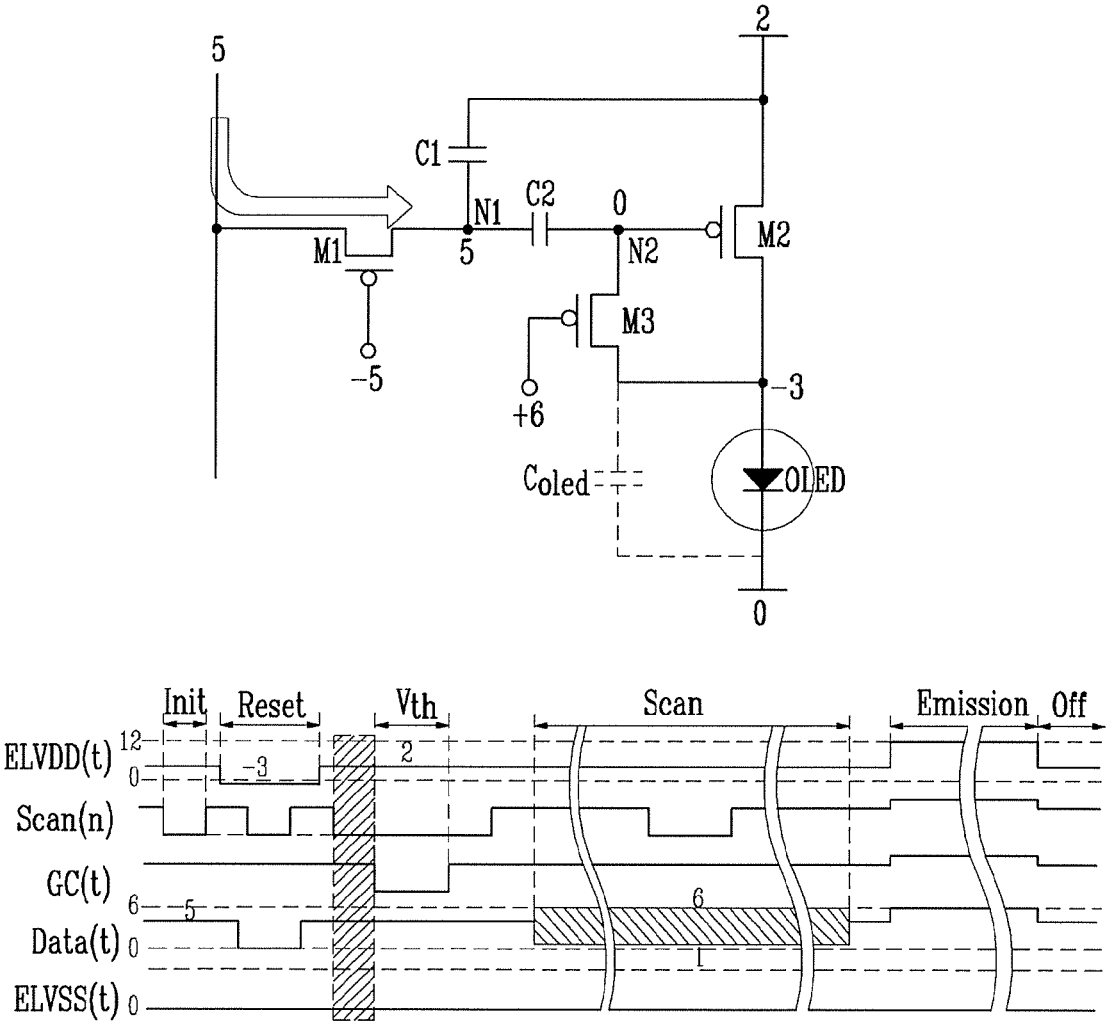
Figure 8F:
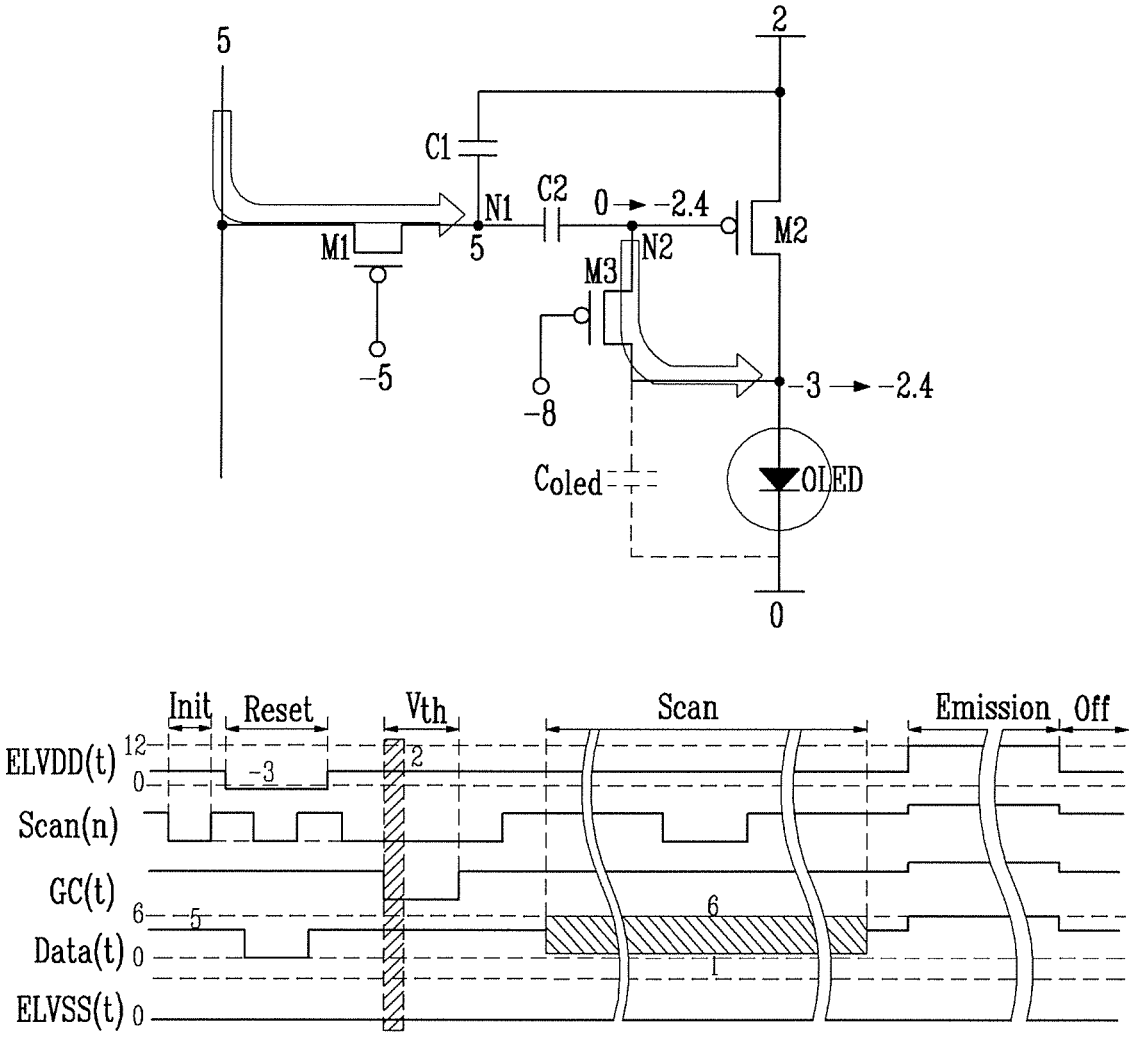

The assumption that the voltage difference across the second capacitor C2 is 5V will be described further through the explanation on the threshold voltage compensation period (FIGS. 8D to 8F).

Further, the initialization step is concurrently applied to the pixels 140 that constitute the display unit 130, wherein the signals applied during the initialization step, that is, the first power ELVDD(t), the scan signal Scan(n), the control signal GC(t), and the data signal Data(t), are applied simultaneously or concurrently to all of the pixels, having the voltage values at respective levels (e.g., predetermined levels).

According to the application of the signals as described above, the first transistor M1 is turned on, and the second transistor M2 and the third transistor M3 are turned off.

Therefore, the voltage 5V that is applied as the initialization signal is applied to the first node N1 through the data line, and the voltage 5V is stored in the second capacitor C2 so that the voltage of the second node N2 becomes 0V.

Next, referring to FIGS. 8B to 8D, this is a period where the data voltages applied to the pixels 140 of the display unit 130, that is, the pixel of FIG. 6, are reset, wherein the voltage of the anode electrode of the organic light emitting diode OLED is dropped below the cathode electrode thereof in order that the organic light emitting diode OLED is not light-emitted.

In the embodiment of FIGS. 8A to 8J, the reset period is processed by being divided into three steps shown in FIGS. 8B to 8D.

First, referring to FIG. 8B, during a first reset period, the first power ELVDD(t) is applied at a low level (for example, −3V), the scan signal Scan(n) is applied at a high level (for example, 6V), and the control signal GC(t) is applied at a high level (for example, 6V).

In other words, as the scan signal Scan(n) is applied at a high level, the first transistor M1, which is a PMOS transistor, is turned off so that the data signal Data(t) is applied having a voltage value at a lower level than the voltage value of the scan signal Scan(n) for the period.

Moreover, the voltage value at a low level that is applied as the first power ELVDD(t) is a negative voltage below the voltage value (for example, 0V) of the second power ELVSS (t), wherein it will be assumed as −3V in FIG. 8B.

As described above, if −3V is applied as the first power ELVDD(t), which is lower by 5V than the voltage value of the first power ELVDD(t) provided during the initialization period of FIG. 8A, that is, 2V, such that the voltage of the first node N1 is also lowered by 5V than its voltage (i.e., 5V) during the initialization period due to the coupling effects of the first capacitor C1 and the second capacitor C2 to become 0V, and the voltage of the second node N2 becomes −5V that is lowered by 5V than its voltage (i.e., 0V) during the initialization period.

However, as mentioned in reference to FIG. 8A, here, the scan signal Scan(n) may be applied at a low level (for example, −5V). In this case, since the first transistor M1 is turned on, the voltage 0V is applied as the data signal Data(t) so that the voltage of the first node N1 becomes 0V.

In other words, considering the case where the voltages of the first node N1 and the second node N2 cannot be sufficiently lowered by the desired voltage due to the parasitic coupling under design limitation conditions, the scan signal may be applied at a low level as described above and the data signal corresponding thereto may be applied at 0V.

If the voltage at the second node N2 becomes −5V as described above, the voltage applied to the gate electrode of the second transistor M2 coupled to the second node N2 becomes −5V so that the second transistor M2 that is implemented as a PMOS transistor is turned on.

Here, as a current path is formed between the first and second electrodes of the second transistor M2, the voltage at the anode electrode of the OLED coupled to the first electrode is gradually dropped to the voltage value of the first power ELVDD(t), that is, −3V.

Next, referring to FIG. 8C, during a second reset period, the first power ELVDD(t) is applied at a low level (for example, −3V), the scan signal Scan(n) is applied at a low level (for example, −5V), and the control signal GC(t) is applied at a high level (for example, 6V). In this case, the first transistor M1 is turned on so that the voltage 0V is applied as the data signal Data(t).

In other words, compared with the first reset period, during the second reset period, the scan signal Scan(n) is applied at a low level (for example, −5V) and the data signal Data(t) corresponding thereto is applied with 0V, wherein this is performed in consideration of the case where the voltages of the first node N1 and the second node N2 cannot be sufficiently lowered by the desired voltage due to the parasitic coupling under design limitation conditions.

Therefore, in another embodiment, the second reset period may maintain the same waveforms as those during the first reset period. In other words, the scan signal Scan(n) applied during the second reset period may be applied at a high level.

Next, referring to FIG. 8D, during a third reset period, the first power ELVDD(t) is applied at a middle level (for example, 2V), the scan signal Scan(n) is applied at a high level (for example, 6V), and the control signal GC(t) is applied at a high level (for example, 6V).

In other words, in the case of the third reset period, the first power ELVDD(t) is restored to have the same voltage value as that during the initialization period as described in FIG. 8A so that the voltage value of the first power ELVDD(t) is increased by 5V from that during the second reset period. Therefore, the voltages of the first node N1 and the second node N2 are raised to 5V and 0V, respectively, due to the coupling effects of the first capacitor C1 and the second capacitor C2.

In other words, the voltages of the respective nodes and the voltage value of the first power ELVDD(t) become the same as those during the initialization period of FIG. 8A.

However, the voltage of the anode electrode of the OLED is applied with −3V that is lower than the voltage value (0V) of the cathode electrode of the OLED throughout the first to third reset periods.

Moreover, in another embodiment, during the third reset period, the scan signal Scan(n) may also be applied at a low level (for example, −5V). However, the data signal Data(t) corresponding to the scan signal Scan(n) should be applied at 5V so that the voltage of the first node N1 can be maintained at 5V.

The reset steps are concurrently applied to all the pixels of the display unit 130 through FIGS. 8B to 8D as described above. Therefore, the signals applied during the first to third reset steps, that is, the first power ELVDD(t), the scan signal Scan(n), the control signal GC(t), and the data signal Data(t), should be applied to all of the pixels, having the voltage values at levels set during the respective periods.

Figure 8G:
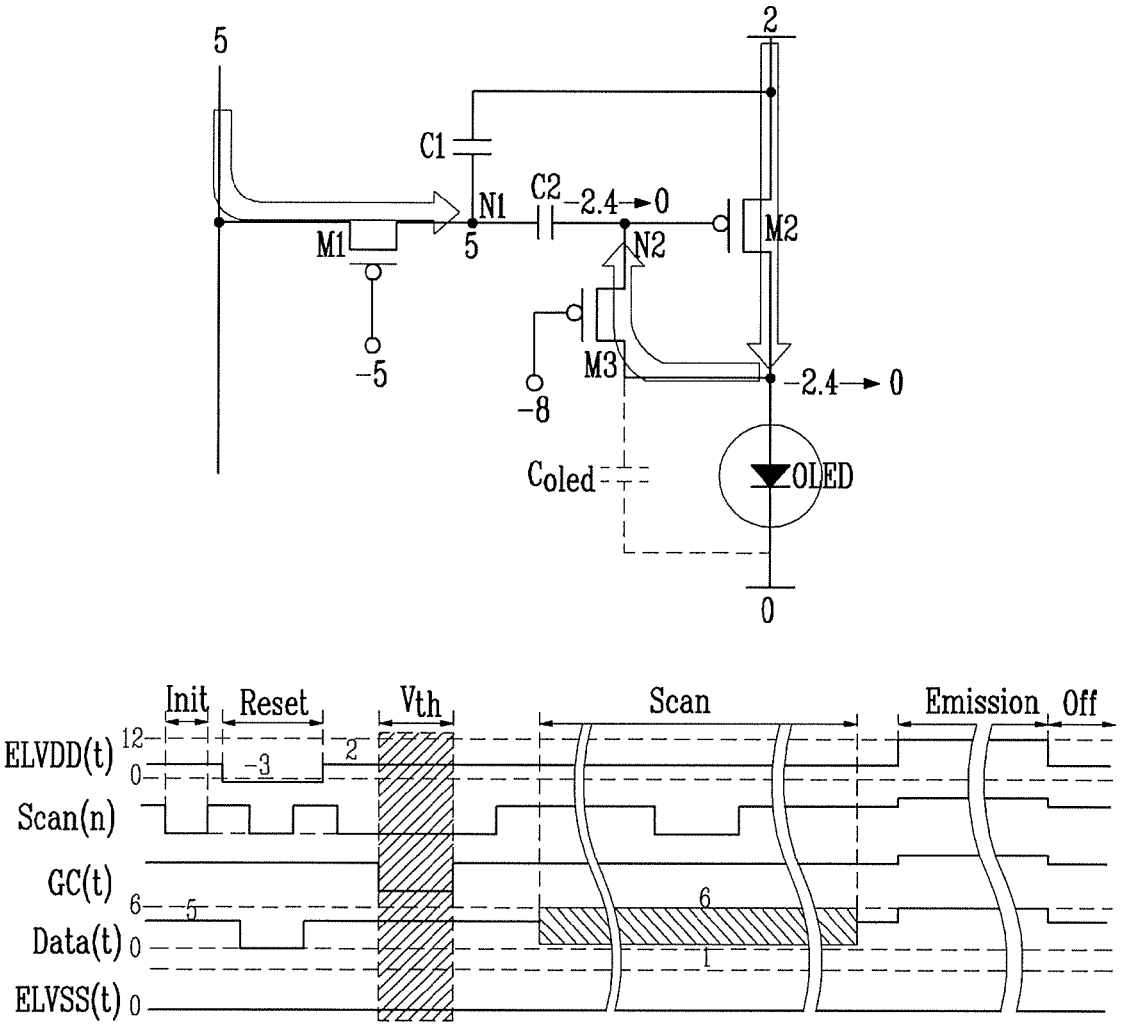

Next, referring to FIGS. 8E to 8G, this is a period where the threshold voltage of the driving transistor M2 provided in the respective pixels 140 of the display unit 130 is stored in the capacitor C2. This will serve to remove the defects due to the deviation in the threshold voltage of the driving transistor when data voltage is charged in the respective pixels 140.

In the embodiment of FIGS. 8E to 8G, the threshold voltage compensation period is processed by being divided into three steps shown in FIGS. 8E to 8G.

First, referring to FIG. 8E, a first threshold voltage compensation period is a step for storing the threshold voltage of the driving transistor, that is, the second transistor, wherein compared with the previous period of FIG. 8D, it is different in that the scan signal Scan(n) is applied at a low level (−5V). In this case, the first transistor M1 is turned on so that the data signal Data(t) applied to the first electrode of the first transistor is applied at 5V that is the same as the voltage of the first node N1 of the previous period shown in FIG. 8D.

In another embodiment, in the case of the first threshold voltage compensation period, the scan signal may be applied at a high level, that is, the signal application waveform of FIG. 8D may be maintained as it is, but the first threshold voltage compensation period of FIG. 8E is implemented in order to prevent the risk that the voltages of the respective nodes N1 and N2 are deviated from the set values due to parasitic coupling.

Next, referring to FIG. 8F, this is a second threshold voltage compensation period, wherein the voltage of the second node N2 is pulled-down.

To this end, the first power ELVDD(t) and the scan signal Scan(n) are applied at a middle level (2V) and a low level (−5V), respectively, in the same manner as in the previous step, and the control signal GC(t) is applied at a low level (for example, −8V).

In other words, the third transistor M3 is turned on according to the application of the signals as described above, and as the third transistor M3 is turned on, the gate electrode and the second electrode of the second transistor M2 are electrically coupled so that the transistor M2 is operated as a diode.

Therefore, the voltage at the second node N2, that is, the voltage applied to the gate electrode of the second transistor M2, is divided by Coled/(C2+Coled) due to the coupling effects of the second capacitor C2 and the parasitic capacitor Coled of the organic light emitting diode OLED.

Here, in one embodiment, when the capacitance ratio between C2 and Coled is 1:4, the voltage of the second node N2 is dropped from 0V to −2.4V (i.e., −3V*4/5) that is the voltage of the anode electrode of the OLED.

In addition, the second node N2 and the anode electrode of the OLED are electrically coupled together as the same node so that the voltage at the anode electrode of the OLED also becomes −2.4V.

Thereafter, referring to FIG. 8G, this is a third threshold voltage compensation period, wherein the waveforms of the applied signals are the same as those during the second threshold voltage compensation period.

However, if the voltage at the second node N2 is dropped to −2.4V as described during the second threshold voltage compensation period, the second transistor M2 as the driving transistor is turned on. Since the second transistor M2 serves as the diode, it is turned on so that current flows until the voltage difference between the first power ELVDD(t) and the anode electrode of the OLED corresponds to the magnitude of the threshold voltage of the second transistor M2 and thereafter, it is turned off.

In other words, for example, the first power ELVDD(t) is applied at 2V and the threshold voltage of the second transistor is −2V so that current flows until the voltage at the anode electrode of the OLED becomes 0V.

Moreover, there is no potential difference between the second node N2 and the anode electrode of the OLED so that if the voltage at the anode electrode becomes 0V, the voltage at the second node N2 also becomes 0V.

However, since the threshold voltage Vth of the second transistor M2 has the deviation (ΔVth), the actual threshold voltage becomes −2V+ΔVth so that the voltage of the second node N2 becomes ΔVth.

Further, the first to third threshold voltage compensation steps are also concurrently applied to all the pixels 140 of the display unit 130. Therefore, the signals applied in the threshold voltage compensation steps, that is, the first power ELVDD(t), the scan signal Scan(n), the control signal GC(t), and the data signal Data(t), are simultaneously (or concurrently) applied to all of the pixels 140, having the voltage values at levels set during the respective periods.

Figure 8H:
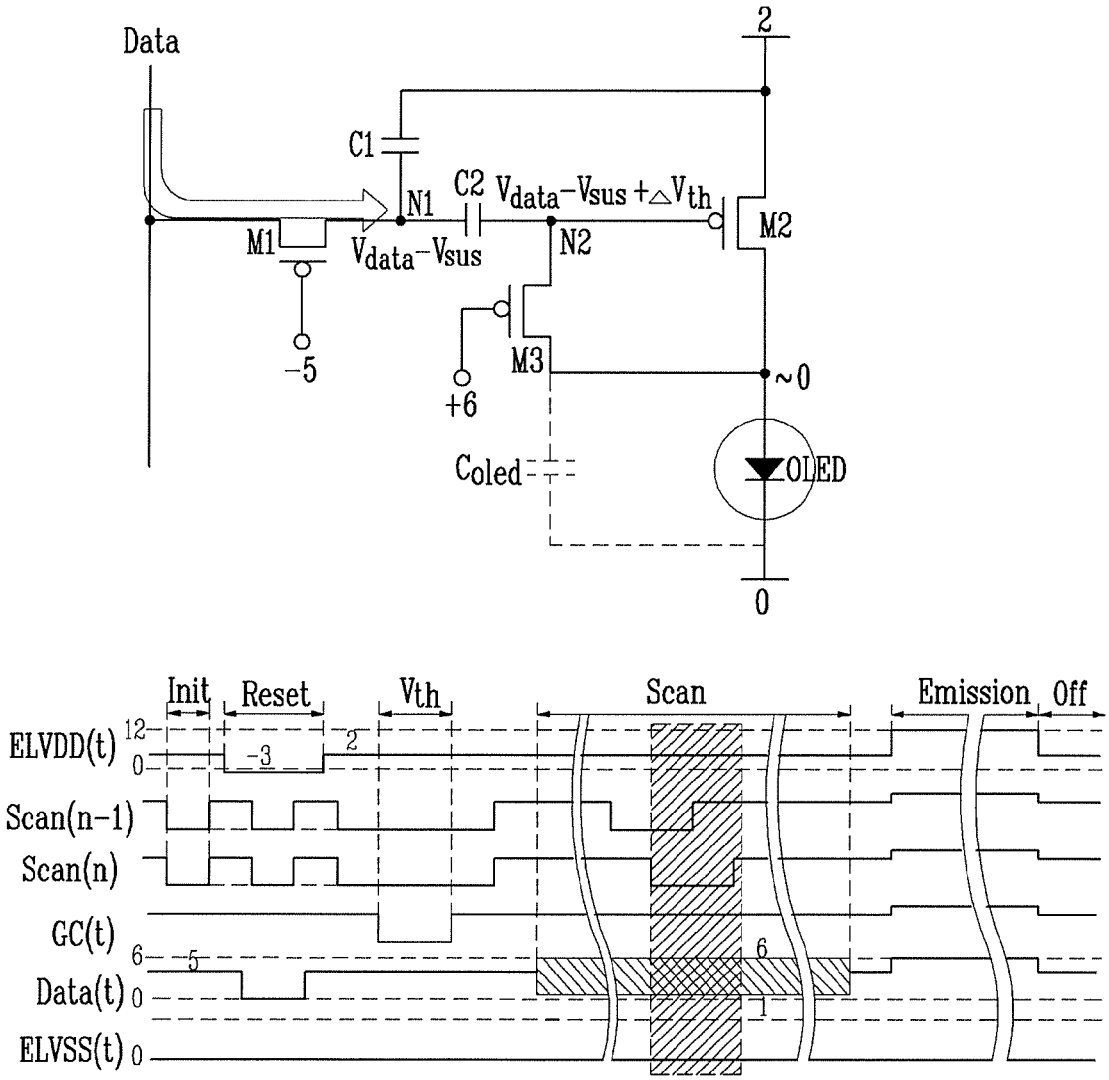

Next, referring to FIG. 8H, this is a step where the scan signals Scan(n) are applied sequentially to the respective pixels 140 of the display unit 130, the pixels being coupled to the scan lines S1 to Sn, so that the data signals Data(t) supplied to the respective data lines D1 to Dm are applied to the pixels 140.

In other words, for the scan/data input period Scan of FIG. 8H, the scan signals Scan(n) are input sequentially to the scan lines S1 to Sn, the data signals corresponding thereto are input sequentially to the pixels 140 coupled to the respective scan lines S1 to Sn, and the control signal GC(t) is applied at a high level (for example, 6V) during the period.

However, in the embodiment of FIG. 8H, the widths of the sequentially applied scan signals are exemplarily applied at two horizontal time 2H, as shown in FIG. 8H. In other words, the width of the $(n-1)^{th}$ scan signals Scan(n−1) and the width of the nth scan signal Scan(n) applied following thereof are applied to be overlapped by 1H.

This is to address the charge shortage phenomenon according to the RC delay of the signal lines due to the large size of the display unit.

Moreover, as the control signal GC(t) is applied at a high level, the third transistor M3, which is a PMOS transistor, is turned off.

In the case of the pixel shown in FIG. 8H, if the scan signal Scan(n) at a low level is applied so that the first transistor M1 is turned on, the data signal Data having a voltage value (e.g., a predetermined voltage value) is applied to the first node N1 via the first and second electrodes of the first transistor M1.

Here, the voltage value of the applied data signal Data is applied in the range of about 1V to about 6V by way of example, and in this case, the voltage 1V is the voltage value representing white, and the voltage 6V is the voltage value representing black.

Here, assuming that the applied data is 6V, the voltage of the first node N1 is increased from 5V, which is the previous initialization voltage Vsus, by 1V. Therefore, the voltage of the second node N2 is also increased by 1V so that the voltage of the second node N2 becomes Vth+1V.

This may be represented by the following equation.

$$\text{Voltage of second node } N2 = \Delta Vth + (Vdata - Vsus) = \Delta Vth + (6V - 5V).$$

However, during the period of FIG. 8H, the voltage 2V is applied to the first power ELVDD(t) so that the second transistor M2 is in a turn-off state. Therefore, a current path is not formed between the OLED and the first power ELVDD(t) so that substantially no current flows to the OLED. In other words, the emission is not performed.

Figure 8I:
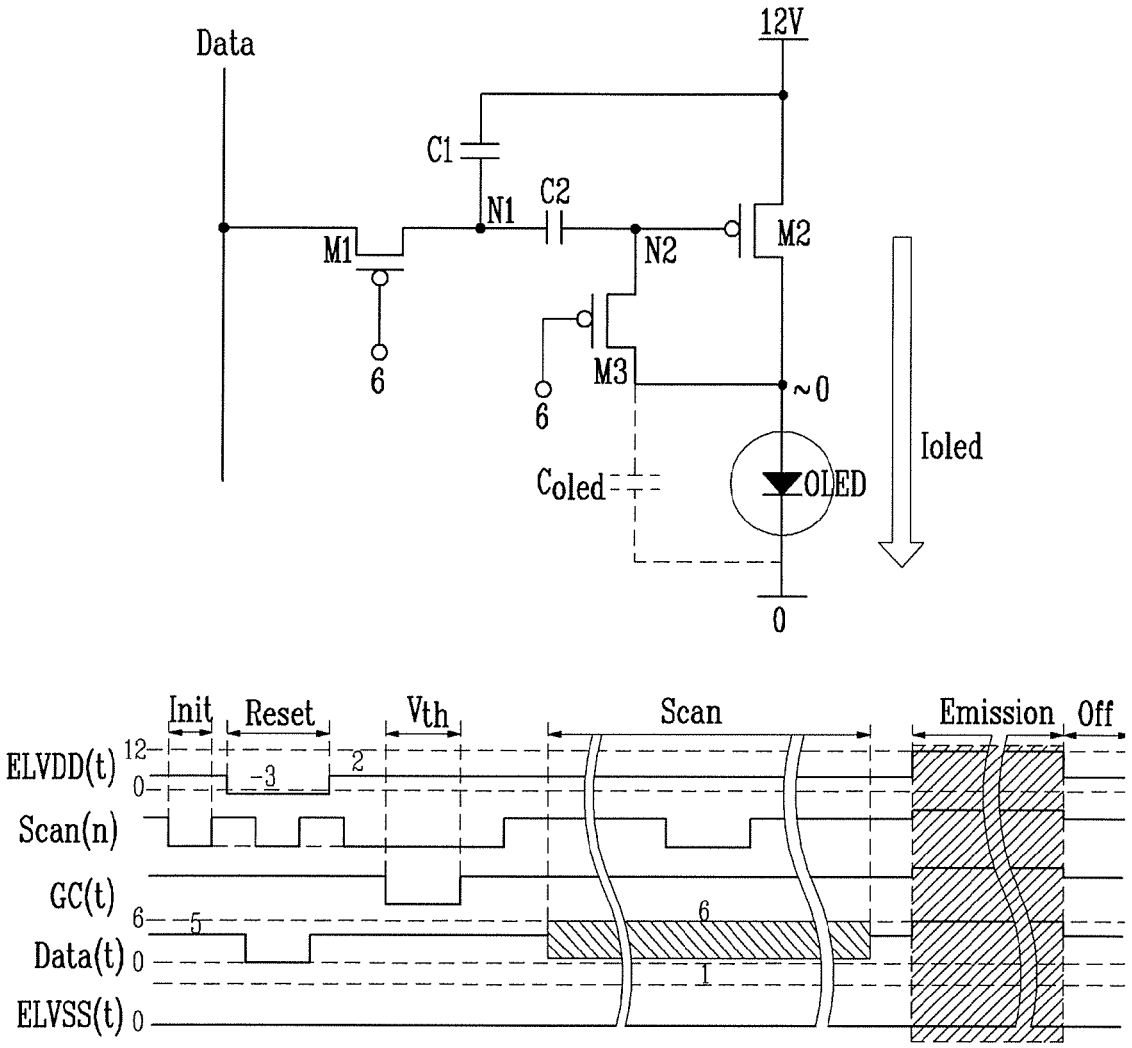

Next, referring to FIG. 8I, this is a period where current corresponding to the data voltage stored in the respective pixels 140 of the display unit 130 is supplied to the organic light emitting diode OLED provided in the respective pixels 140 so that the emission is performed.

In other words, during the emission period Emission of FIG. 8I, the first power ELVDD(t) is applied at a high level (for example, 12V), and the scan signal Scan(n) and the control signal GC(t) are applied at a high level (for example, 6V), respectively.

Therefore, as the scan signal Scan(n) is applied at a high level, the first transistor M1, which is a PMOS transistor, is turned off so that the data signal Data may be supplied at any levels for the period.

Moreover, the emission step is also concurrently applied to all of the pixels 140 of the display unit 130 so that the signals applied during the emission step, that is, the first power ELVDD(t), the scan signal Scan(n), the control signal GC(t), and the data signal Data(t), are simultaneously (or concurrently) applied to all of the pixels 140, having the voltage values set at respective levels.

Further, as the control signal GC(t) is applied at a high level, the third transistor M3, which is a PMOS transistor, is turned off so that the second transistor M2 serves as a driving transistor.

Therefore, the voltage applied to the gate electrode of the second transistor M2, which is the voltage applied to the second node N2, is ΔVth+1, and the first power ELVDD(t) applied to the first electrode of the second transistor M2 is applied at a high level (for example, 12V) so that the second transistor M2, which is a PMOS transistor, is turned on.

As the second transistor M2 is turned on as described above, a current path is formed between the first power ELVDD(t) and the cathode electrode of the OLED. Therefore, the current corresponding to the Vgs voltage value of the second transistor M2, that is, the voltage corresponding to the voltage difference between the gate electrode and the first electrode of the second transistor M2, is applied to the organic light emitting diode OLED so that it is light-emitted at brightness corresponding thereto.

In other words, the current flowing through the organic light emitting diode OLED is represented by $Ioled=\beta/2(Vgs-Vth)^2=\beta/2(Vdata-Vsus)^2$ so that in the above described embodiment of the present invention, the current flowing through the organic light emitting diode OLED compensates for the deviation ΔVth in the threshold voltage of the second transistor M2.

Figure 8J:
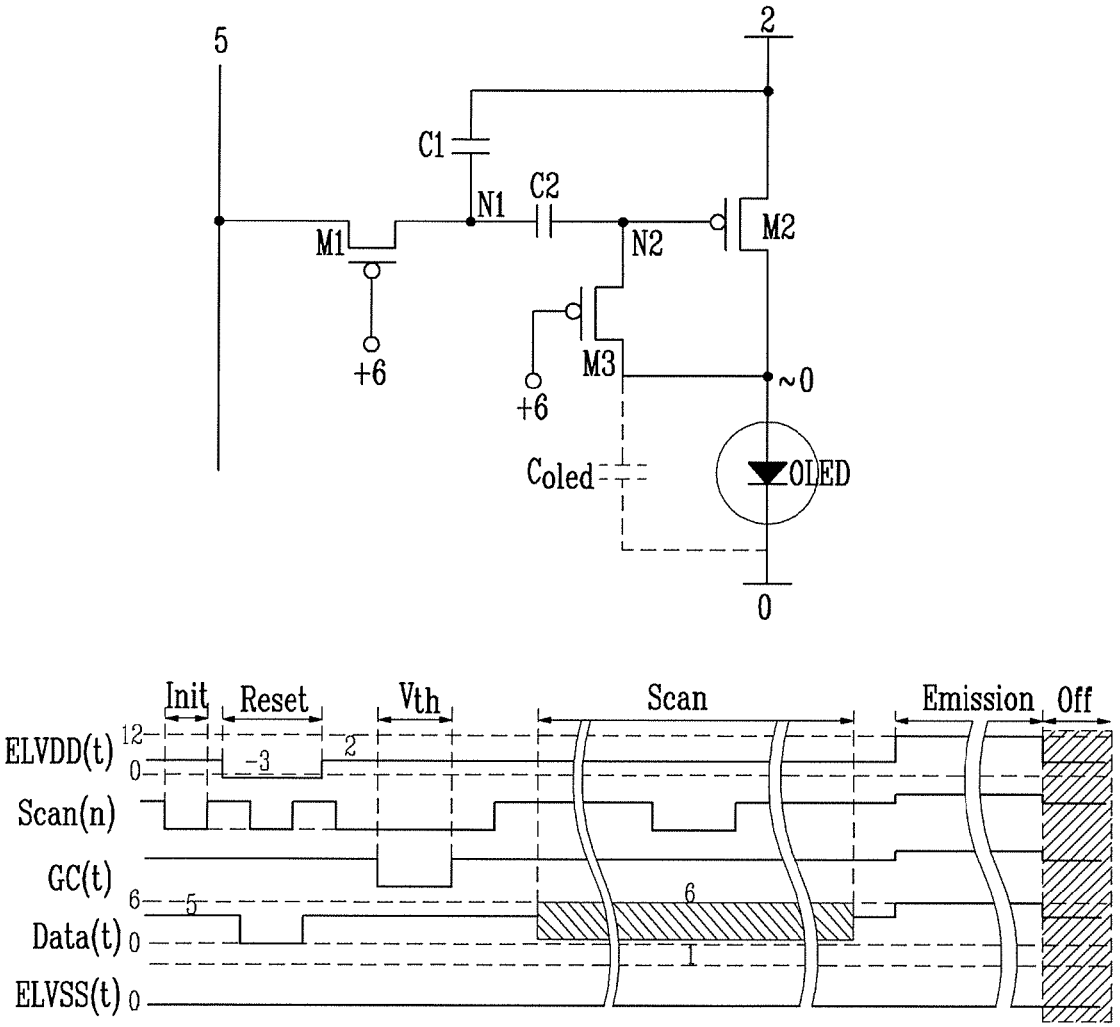

After the emission is performed on all of the pixels 140 of the display unit 130 as described above, an emission turn-off step Off is performed as shown in FIG. 8J.

Referring to FIG. 8J, during the emission turn-off period Off, the first power ELVDD(t) is applied at a middle level (for example, 2V), the scan signal Scan(n) is applied at a high level (for example, 6V), and the control signal is applied at a high level (for example, 6V).

In other words, compared with the emission period of FIG. 8I, it is the same except that the first power ELVDD(t) is changed from the high level to the middle level (for example, 2V).

This is the period where the emission is turned off for a black insertion or a dimming after the emission operation, wherein if the OLED is formerly light-emitted, the voltage value of the anode electrode of the OLED is dropped in voltage within several tens of micro seconds (us) such that the emission is turned off.

As described above, one frame is implemented through the periods of FIGS. 8A to 8J, and it is continuously repeated, thereby forming the following frames. In other words, after the emission turn-off period Off of FIG. 8J, the initialization period Init of FIG. 8A is processed again.

Figure 9:
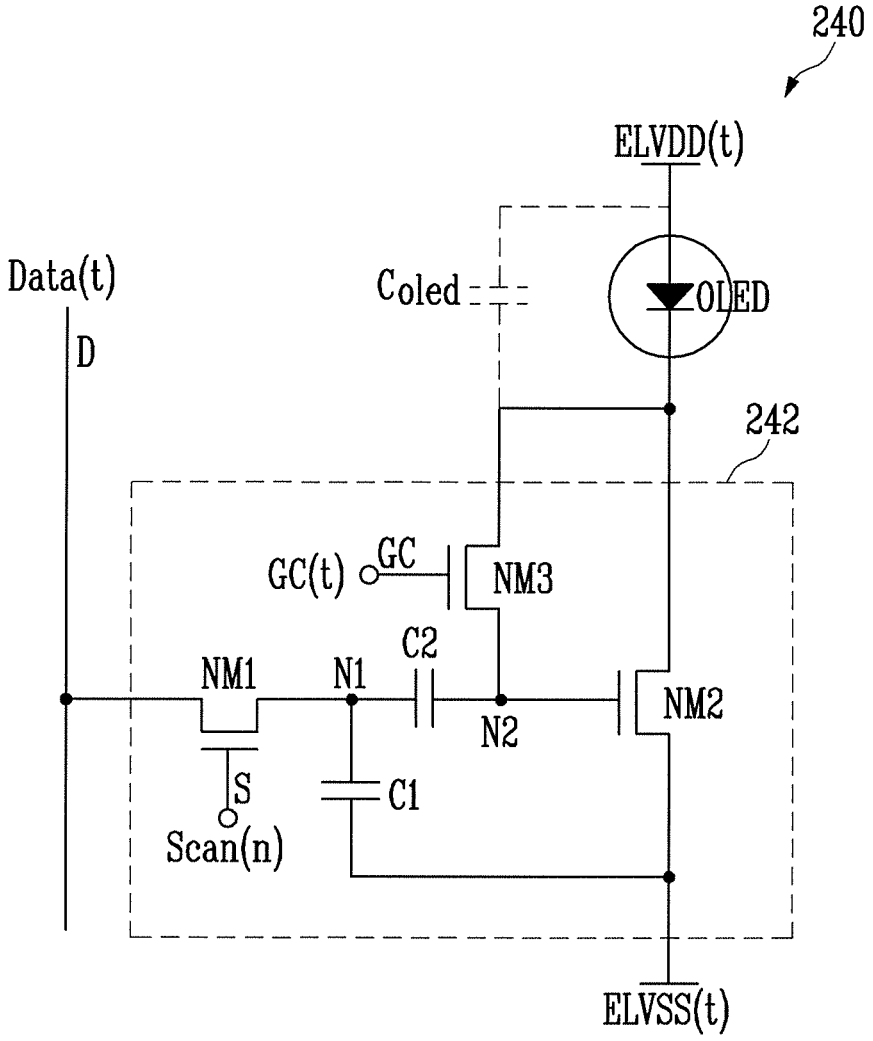
FIG. 9 is a circuit diagram of the pixel in FIG. 1 according to another embodiment of the present invention.

FIG. 9 is a circuit diagram of a pixel of FIG. 1 according to another embodiment of the present invention.

Referring to FIG. 9, compared with the embodiment of FIG. 6, it is different in that transistors that constitute a pixel circuit are implemented as NMOS transistors.

In this case, compared with the driving timing diagrams of FIGS. 7A to 7C, the driving waveforms and the polarities of a scan signal Scan(n), a control signal GC(n), first power ELVDD(t), second power ELVSS(t), and a data signal Data(t) supplied other than during a data write period are inverted and supplied.

Consequently, compared with the embodiment of FIG. 6, in the embodiment of FIG. 9, the transistors are implemented as NMOS transistors and not PMOS transistors, but the driving operations and the principles thereof are the same as the embodiment of FIG. 6, and thus, the detailed description thereof will be omitted.

Referring to FIG. 9, the pixel 240 in the embodiment of the present invention includes an OLED and a pixel circuit 242 that supplies current to the OLED.

The cathode electrode of the OLED is coupled to the pixel circuit 242, and the anode electrode thereof is coupled to the first power supply ELVDD(t). The OLED generates light having a brightness (e.g., a predetermined brightness) corresponding to the current supplied by the pixel circuit 242.

However, in the embodiment of FIG. 9, the pixels 240 that constitute the display unit 130 receive data signals supplied to the data lines D1 to Dm when scan signals are supplied sequentially to the scan lines S1 to Sn for a partial period (the aforementioned (d) step) of one frame, but the scan signals applied to the respective scan signals S1 to Sn, the first power ELVDD(t) and/or the second power ELVSS(t) applied to the respective pixels 240, control signals applied to respective control lines GC1 to GCn are simultaneously (or concurrently) applied to the pixels 240, having respective voltage levels (e.g., predetermined voltage levels), for other periods ((a), (b), (c), (e), and (f) steps) of one frame.

In the embodiment of FIG. 9, the pixel circuit 242 that is provided in the respective pixels 240 includes three transistors NM1 to NM3 and two capacitors C1 and C2.

Herein, the gate electrode of the first transistor NM1 is coupled to a scan line S and the first electrode of the first transistor NM1 is coupled to a data line D. And, the second electrode of the first transistor NM1 is coupled to a first node N1.

In other words, the scan signal Scan(n) is applied to the gate electrode of the first transistor NM1, and the data signal Data(t) is input into the first electrode of the first transistor NM1.

The gate electrode of the second transistor NM2 is coupled to a second node N2, the first electrode of the second transistor NM2 is coupled to the second power supply ELVSS(t), and the second electrode thereof is coupled to the cathode electrode of the organic light emitting diode OLED. Here, the second transistor NM2 serves as a driving transistor.

Further, the first capacitor C1 is coupled between the first node N1 and the first electrode of the second transistor NM2, that is, the second power supply ELVSS(t), and the second capacitor C2 is coupled between the first node N1 and the second node N2.

In addition, the gate electrode of the third transistor NM3 is coupled to a control line GC, the first electrode of the third transistor NM3 is coupled to the gate electrode of the second transistor NM2, and the second electrode of the third transistor NM3 is coupled to the cathode electrode of the OLED, which is coupled to the second electrode of the second transistor NM2.

Therefore, the control signal GC(t) is applied to the gate electrode of the third transistor NM3, wherein when the third transistor NM3 is turned on, the second transistor NM2 is diode-connected.

In addition, the anode electrode of the organic light emitting diode OLED is coupled to the first power supply ELVDD (t).

In the embodiment of FIG. 9, all of the first to third transistors NM1 to NM3 are implemented as NMOS transistors.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A driving method of an organic light emitting display, the method comprising:

(a) initializing voltages of respective nodes of a plurality of pixel circuits included in respective pixels by concurrently applying a first power, a second power, scan signals, control signals, and data signals, all having voltage values at respective levels, to all of the pixels in a display unit;

(b) decreasing a voltage of an anode electrode of an organic light emitting diode (OLED) included in the respective pixels below a voltage of a cathode electrode of the OLED by concurrently applying the first power, the second power, the scan signals, the control signals, and the data signals, all having the voltage values at respective levels, to all of the pixels, wherein (b) occurs after (a), and the voltage value of at least one of the first power or the second power in (b) is different from that applied in (a);

(c) storing a threshold voltage of a driving transistor included in the respective pixels by concurrently applying the first power, the second power, the scan signals, the control signals, and the data signals, all having the voltage values at respective levels, to all of the pixels;

(d) applying the scan signals sequentially to the pixels coupled to scan lines of the display unit and applying the data signals to the pixels by each of the scan lines corresponding to the sequentially applied scan signals;

(e) light-emitting concurrently all of the pixels at brightness corresponding to the data signals stored in the respective pixels by concurrently applying the first power, the second power, the scan signals, the control signals, and the data signals, all having the voltage values at respective levels, to all of the pixels; and (f) turning off emission of the pixels by concurrently applying the first power, the second power, the scan signals, the control signals, and the data signals, all having the voltage values at respective levels, to all of the pixels and thus lowering the voltage of the anode electrode of the OLED included in the respective pixels, wherein (f) occurs after (e) in a same frame.

2. The driving method of the organic light emitting display as claimed in claim 1, wherein one frame is implemented through (a) to (f).

3. The driving method of the organic light emitting display as claimed in claim 2, wherein for a progressively displayed frame, an $n^{th}$ frame displays a left-eye image and an $(n+1)^{th}$ frame displays a right-eye image.

4. The driving method of the organic light emitting display as claimed in claim 3, wherein an entire time between an emission period of the $n^{th}$ frame and an emission frame of the $(n+1)^{th}$ frame is synchronized with a response time of a pair of shutter glasses.

5. The driving method of the organic light emitting display as claimed in claim 1, wherein each of the pixels comprises:

a first PMOS transistor having a gate electrode coupled to a scan line of the scan lines, a first electrode coupled to a data line, and a second electrode coupled to a first node;

a second PMOS transistor having a gate electrode coupled to a second node, a first electrode coupled to the first power, and a second electrode;

a first capacitor coupled between the first node and the first electrode of the second PMOS transistor;

a second capacitor coupled between the first node and the second node;

a third PMOS transistor having a gate electrode coupled to a control line, a first electrode coupled to the gate electrode of the second PMOS transistor, and a second electrode coupled to the second electrode of the second PMOS transistor; and an organic light emitting diode (OLED) having an anode electrode coupled to the second electrode of the second PMOS transistor and a cathode electrode coupled to the second power.

6. The driving method of the organic light emitting display as claimed in claim 5, wherein in (a), the first power is applied at a middle level, the scan signals are applied at a low level, and the control signals are applied at a high level.

7. The driving method of the organic light emitting display as claimed in claim 5, wherein (b) comprises:

(b1) wherein the first power is applied at a low level, the scan signal is applied at a high level or a low level, and the control signals are applied at a high level;

(b2) wherein the first power is applied at a low level, the scan signals are applied at a high level or a low level, and the control signals are applied at a high level; and (b3) wherein the first power is applied at a middle level, the scan signals are applied at a high level or a low level, and the control signals are applied at a high level.

8. The driving method of the organic light emitting display as claimed in claim 7, wherein in (b1) and (b2), if the scan signals are applied at a low level, the data signals corresponding thereto are applied at a low level.

9. The driving method of the organic light emitting display as claimed in claim 7, wherein in (b3), if the scan signals are applied at a low level, the data signals corresponding thereto are applied at a high level.

10. The driving method of the organic light emitting display as claimed in claim 5, wherein in (d), the control signals are applied at a low level.

11. The driving method of the organic light emitting display as claimed in claim 5, wherein in (e), the first power is applied at a high level, and the scan signals and the control signals are applied at a high level.

12. The driving method of the organic light emitting display as claimed in claim 5, wherein in (f), the first power is applied at a middle level, and the scan signals and the control signals are applied at a high level.

13. A driving method of an organic light emitting display, the method comprising:

(a) initializing voltages of respective nodes of a plurality of pixel circuits included in respective pixels by concurrently applying a first power, a second power, scan signals, control signals, and data signals, all having voltage values at respective levels, to all of the pixels in a display unit;

(b) decreasing a voltage of an anode electrode of an organic light emitting diode (OLED) included in the respective pixels below a voltage of a cathode electrode of the OLED by concurrently applying the first power, the second power, the scan signals, the control signals, and the data signals, all having the voltage values at respective levels, to all of the pixels, wherein (b) occurs after (a), and the voltage value of at least one of the first power and the second power in (b) is different from that applied in (a);

(c) storing a threshold voltage of a driving transistor included in the respective pixels by concurrently applying the first power, the second power, the scan signals, the control signals, and the data signals, all having the voltage values at respective levels, to all of the pixels;

(d) applying the scan signals sequentially to the pixels coupled to scan lines of the display unit and applying the data signals to the pixels by each of the scan lines corresponding to the sequentially applied scan signals;

(e) light-emitting concurrently all of the pixels at brightness corresponding to the data signals stored in the respective pixels by concurrently applying the first power, the second power, the scan signals, the control signals, and the data signals, all having the voltage values at respective levels, to all of the pixels; and (f) turning off emission of the pixels by concurrently applying the first power, the second power, the scan signals, the control signals, and the data signals, all having the voltage values at respective levels, to all of the pixels and thus lowering the voltage of the anode electrode of the OLED included in the respective pixels, wherein (f) occurs after (e) in a same frame, wherein each of the pixels comprises:

a first PMOS transistor having a gate electrode coupled to a scan line of the scan lines, a first electrode coupled to a data line, and a second electrode coupled to a first node;

a second PMOS transistor having a gate electrode coupled to a second node, a first electrode coupled to the first power, and a second electrode;

a first capacitor coupled between the first node and the first electrode of the second PMOS transistor;

a second capacitor coupled between the first node and the second node;

a third PMOS transistor having a gate electrode coupled to a control line, a first electrode coupled to the gate electrode of the second PMOS transistor, and a second electrode coupled to the second electrode of the second PMOS transistor; and an organic light emitting diode (OLED) having an anode electrode coupled to the second electrode of the second PMOS transistor and a cathode electrode coupled to the second power, and wherein (c) comprises:

(c1) wherein the first power is applied at a middle level, the scan signals are applied at a high level or a low level, and the control signals are applied at a high level; and (c2) and (c3) wherein the first power is applied at a middle level, the scan signals are applied at a low level, and the control signals are applied at a low level.

14. The driving method of the organic light emitting display as claimed in claim 13, wherein in (c1), if the scan signals are applied at a low level, the data signals corresponding thereto are applied at a high level.

15. A driving method of an organic light emitting display, the method comprising:

(a) initializing voltages of respective nodes of a plurality of pixel circuits included in respective pixels by concurrently applying a first power, a second power, scan signals, control signals, and data signals, all having voltage values at respective levels, to all of the pixels in a display unit;

(b) decreasing a voltage of an anode electrode of an organic light emitting diode (OLED) included in the respective pixels below a voltage of a cathode electrode of the OLED by concurrently applying the first power, the second power, the scan signals, the control signals, and the data signals, all having the voltage values at respective levels, to all of the pixels, wherein (b) occurs after (a), and the voltage value of at least one of the first power and the second power in (b) is different from that applied in (a);

(c) storing a threshold voltage of a driving transistor included in the respective pixels by concurrently applying the first power, the second power, the scan signals, the control signals, and the data signals, all having the voltage values at respective levels, to all of the pixels;

(d) applying the scan signals sequentially to the pixels coupled to scan lines of the display unit and applying the data signals to the pixels by each of the scan lines corresponding to the sequentially applied scan signals;

(e) light-emitting concurrently all of the pixels at brightness corresponding to the data signals stored in the respective pixels by concurrently applying the first power, the second power, the scan signals, the control signals, and the data signals, all having the voltage values at respective levels, to all of the pixels; and (f) turning off emission of the pixels by concurrently applying the first power, the second power, the scan signals, the control signals, and the data signals, all having the voltage values at respective levels, to all of the pixels and thus lowering the voltage of the anode electrode of the OLED included in the respective pixels, wherein (f) occurs after (e) in a same frame, wherein each of the pixels comprises:

a first PMOS transistor having a gate electrode coupled to a scan line of the scan lines, a first electrode coupled to a data line, and a second electrode coupled to a first node;

a second PMOS transistor having a gate electrode coupled to a second node, a first electrode coupled to the first power, and a second electrode;

a first capacitor coupled between the first node and the first electrode of the second PMOS transistor;

a second capacitor coupled between the first node and the second node;

a third PMOS transistor having a gate electrode coupled to a control line, a first electrode coupled to the gate electrode of the second PMOS transistor, and a second electrode coupled to the second electrode of the second PMOS transistor; and an organic light emitting diode (OLED) having an anode electrode coupled to the second electrode of the second PMOS transistor and a cathode electrode coupled to the second power, and wherein in (d), widths of the sequentially applied scan signals are applied at two horizontal time, adjacently applied ones of the scan signals being applied to be overlapped with each other by one horizontal time.

* * * * *